United States Patent [19]

Annis

[11] 4,153,499

[45] May 8, 1979

[54] SLIP-FEED STRAPPING MACHINE

[75] Inventor: James R. Annis, Palatine, Ill.

[73] Assignee: Signode Corporation, Glenview, Ill.

[21] Appl. No.: 805,645

[22] Filed: Jun. 13, 1977

[51] Int. Cl.[2] ..... B65B 13/10

[52] U.S. Cl. ..... 156/494; 100/27; 100/28; 100/33 PB; 156/502

[58] Field of Search ..... 156/73.5, 494, 502; 100/2, 5, 6, 9, 16, 27, 28, 33 PB

[56] References Cited

U.S. PATENT DOCUMENTS

| | | | |
|---|---|---|---|
| 2,687,083 | 8/1954 | Cranston | 100/28 |
| 2,705,914 | 4/1955 | Cranston | 100/28 |
| 3,232,216 | 2/1966 | Cranston et al. | 100/28 |
| 3,324,789 | 6/1967 | Buettner | 100/27 |
| 3,331,312 | 7/1967 | Leslie et al. | 100/28 |
| 3,548,740 | 12/1970 | Kobiella | 156/73.5 |

*Primary Examiner*—Caleb Weston
*Attorney, Agent, or Firm*—Dressler, Goldsmith, Clement, Gordon & Shore, Ltd.

[57] ABSTRACT

A cyclicly operable machine for providing a tensioned loop of fusible thermoplastic strapping about a loosely positioned object, wherein a hoop-mounted slip-feed carrier is caused to orbit the object in one direction while one end of the strapping is held by a gripper. In so orbiting, the carrier progressively wraps a closed loop about the object, the loop having overlapping ends which become sealed to each other by a friction-fusion operation. Such sealing accomplished by a cooperating anvil and vibrator which move into the strap path to create the seal and away from the path to allow the sealed loop to completely seize the object, after which a cutter severs the excess strapping from the object. A reverse orbiting of the carrier similarly applied a successive strap loop to the object. A strap storage and dispenser system, including a strap reel, supplies strapping to the carrier and has facilities whereby, during initial application of the loop, the relatively light tension which is applied will not unseal or dislodge the loosely positioned object and whereby, after the loop is completed, a high degree of tension becomes effective to draw the loop tight around the object immediately prior to the sealing operation. Initial movement of the carrier in either direction feeds strapping back into the storage and dispenser system during partial object wrapping, but continued motion of the carrier again withdraws such stored strapping during final wrapping. A pinch or drag roller normally inhibits withdrawal of strapping from the reel during use of the stored strapping but releases the reel to pay out strapping when the stored strapping is exhausted. Novel means are provided for actuating the vibrator, the anvil, the gripper and the cutter at appropriate points in the machine cycle.

32 Claims, 28 Drawing Figures

P
12
14
102
112
129
132
136
137
138
160
166
170
172
174
176
164
182
184
122
131
130
186
16
18
34
39
70
72a
72b
72c
72d
72e
72f
72g
72h
74
76
80
82
88
90
92
94
S

P
12
14
102
112
129
132
136
137
138
160
166
170
172
174
176
164
182
184
122
131
130
186
16
18
20
39
64
66
70
72b
72c
72d
72e
72f
72g
72h
74
76
80
82
88
90
92
94
S 506
508
412
414
418
502
512
520
522
526
529
530
531
532
536
537
538
560
564
566
570
576
582
584
586
600
601
602
606
S 530
532
533
582
586
580
604
588
606
608

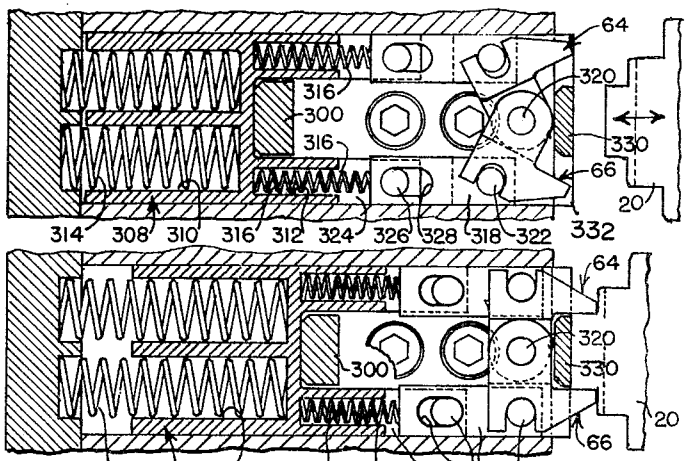
FIG. 25
FIG. 24
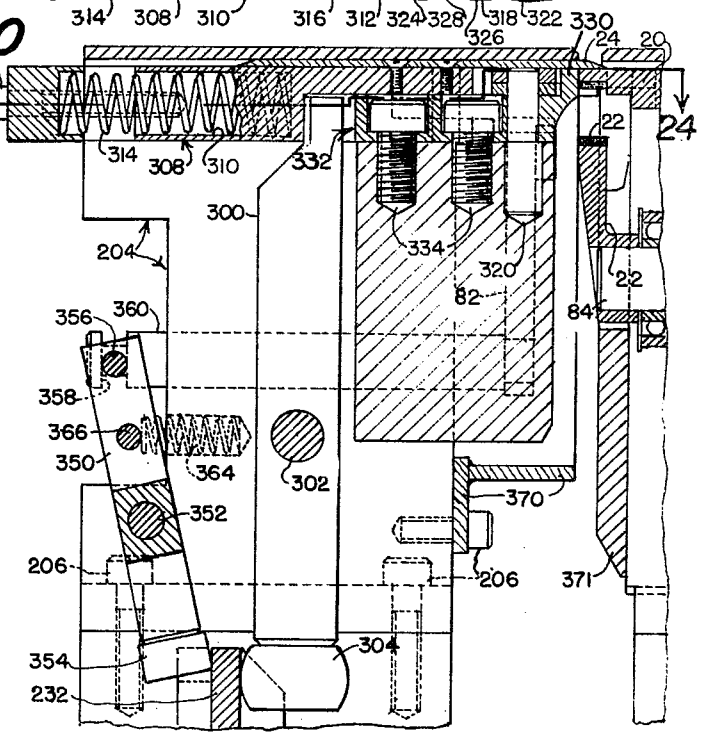
FIG. 20
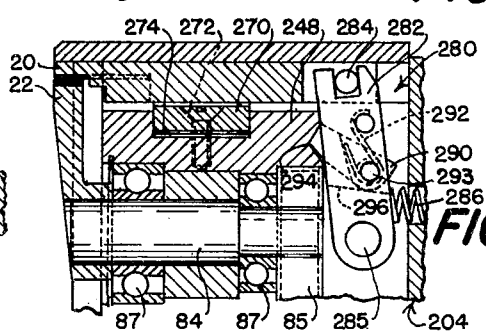
FIG. 23
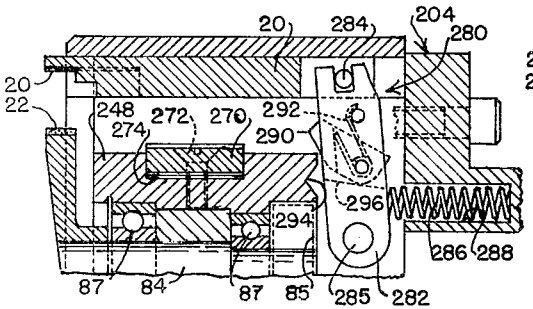
FIG. 22
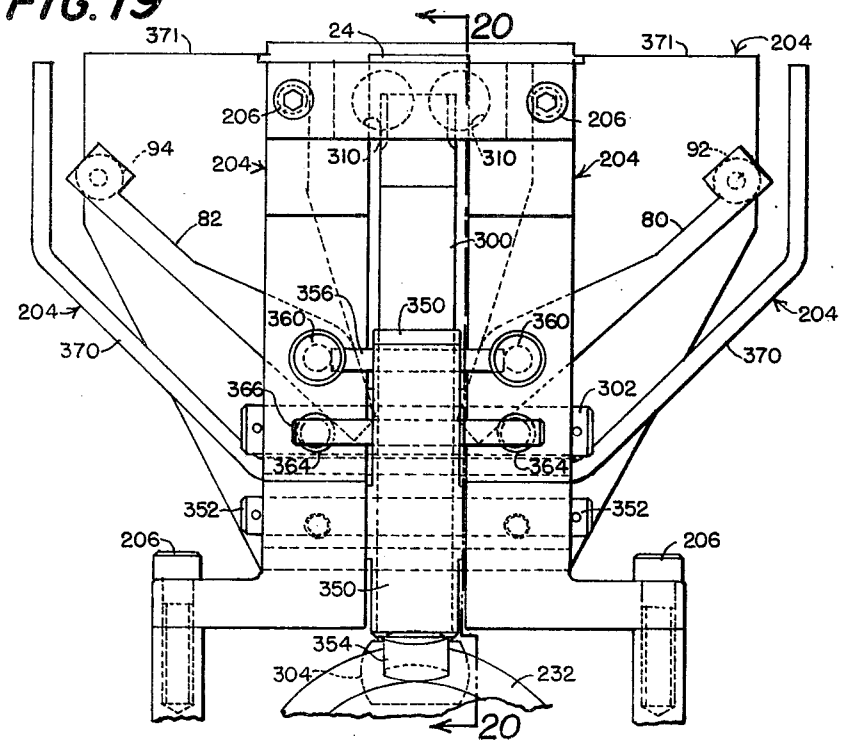
FIG. 19

SLIP-FEED STRAPPING MACHINE

The present invention relates to strapping apparatus of the general type wherein a length of fusible thermoplastic strapping is withdrawn from a source of strapping and caused to encircle a package or other object undergoing banding so as to establish a closed loop having overlapping end portions which subsequently become united to each other by a friction-fusion operation to provide a seal or joint, after which the excess strapping is severed from the loop to free the package from the source.

In the commercial application of strapping material to a package for banding purposes, whether such material be formed of relatively flexible plastic ribbon stock or of wire stock, three basic methods of application are currently in use. By far the most prevalent method embodies the use of a strap chute which encompasses the package and through which the strapping material is forced endwise to produce the loop about the article, the loop being subsequently pulled centripetally inwards from the chute, tensioned about the package, and the overlapping ends thereof sealed together either by friction fusion or by crimping a metal seal thereon or, in the case of wire, twisting such overlapping ends together. Numerous difficulties are encountered by this method, especially where the strap loop is large. Not only must delicate controls be employed to measure the amount of strap feed to avoid overfeeding or underfeeding, but frictional problems arise by reason of camber, curl and twist effects which ordinarily are present with lightweight strapping.

In another method, the free end of the strapping is fixedly secured to a carrier which orbits the package and returns to its starting point to create the loop, after which the overlapping ends of the loop are sealed together. This method also is possessed of disadvantages in that only the wrapping operation is automatic since the final sealing or joint forming operation is conducted by a hand tool, the use of which requires manual dexterity.

In a third method, the free end of the strapping material is clamped in position adjacent to the object or package and a slip-feed carrier which orbits the package wraps the strapping under tension to produce the loop with its overlapping ends. This third method obviates many of the difficulties associated with the two other methods but it also has its own limitations as currently used. It is to this third method that the present invention specifically relates.

Principal among the limitations that are attendant upon the slip-feed method of banding a package, is the lack of an efficient strap dispensing system for feeding the strapping from a strap spool or reel to the slip-feed carrier. Most slip-feed systems employ a carrier which is reversible so that a clockwise package wrapping operation may be immediately followed by a counterclockwise wrapping operation, thus providing for the application of multiple strap loops to the package. In either event, the nature of these slip-feed systems is such that it is impractical to pull the strapping directly from the strap reel since the inertia of the latter would, on occasions, place a heavy tension in the strapping tending to dislodge the package from its support by a jerking action. Accordingly, such slip-feed systems make provision for storing a quantity of strapping necessary to perform the strapping operation in an accumulator box or section and then using this stored strapping first for strapping purposes. When the stored strapping is exhausted, an additional quantity of strapping is applied from the reel to the accumulator section, ready for the next succeeding strapping operation. Despite the use of an accumulator box of this nature, special provision must be made for maintaining tension in the strapping for wrapping purposes as the stored strapping is being used. The tension that is required is sufficiently great as to make it necessary to clamp the package on its support, especially where relatively light or small packages are concerned, so that the pulling tension will not dislodge the package during wrapping thereof.

The present invention is designed to overcome the above-noted limitations that are attendant upon the construction and use of such conventional strapping apparatus and systems, particularly systems of the slip-feed type, and, toward this end, it contemplates the provision of an oribiting slip-feed carrier which, upon initial wrapping motion thereof creates a length of strapping which, because it is not immediately applied to the package for wrapping purposes, becomes excess strapping which must be disposed of until it is needed for wrapping purposes. Accordingly, such excess strapping is returned to the dispensing system from which it originally was drawn and, in such dispensing system, it is stored under tension and held under such tension until it is needed for wrapping purposes. At this time it is again withdrawn from the dispenser under the proper degree of wrapping tension while at the same time the strapping which is wound on the strap reel is prevented from being payed out from the reel until substantially all of the stored strapping has been used for wrapping purposes. Furthermore, shortly before the entire quantity of stored strapping in the dispensing system is exhausted, the storage tension is greatly increased, such increased tension taking place as soon as the strap loop has been completed around the package. This increase of tension pulls the strap loop tight about the package immediately prior to the effecting of the sealing operation. Then, while the seal is being established and after the package is fully banded, the mechanism which normally operates to maintain the stored strapping under wrapping tension, now operates to pull the necessary quantity of strapping from the strap reel, so that it is capable of supplying such fresh strapping to the storage area of the dispensing system as is necessary to replace the strapping which has been withdrawn therefrom during the wrapping cycle regardless of whether it is a clockwise or a counterclockwise wrapping cycle. The provision of a strapping apparatus embodying a dispensing system such as has briefly been outlined above constitutes one of the principal objects of the present invention.

Another limitation that is attendant upon the construction, and use of conventional slip-feed type wrapping apparatus and systems, especially those which operate with plastic ribbon-type strapping, resides in the complexity of the slip-feed carrier mounting which heretofore has been carried by an endless chain which encompasses the strapping area and is reversible in opposite directions for carrier orbiting purposes. The driving mechanism for such chain, involving as it does a drive sprocket and numerous chain guide idler sprockets which, considered collectively, constitute a relatively complicated drive system which is extremely noisy in its operation and involves a large number of relatively movable parts. The carrier supporting chain is functionally associated with a slack take-up chain which also is power driven and thus all of these chain and sprocket devices which are employed greatly increase the maintenance costs involved.

The present invention is also designed to overcome the above-noted limitations that are attendant upon the use of a chain driven carrier and, accordingly, it is contemplated that in place of a chain supported slip-feed carrier, the carrier be mounted on a circular hoop-like motivating member which encompasses the strapping area, is conveniently mounted on four quadrilaterally arranged pinch rollers, one of which is motor driven for frictional motivation of the hoop-like motivating member, with the entire arrangement being conducive toward extreme simplicity and quietness or smoothness of operation, as well as to cost reduction. Hoop-like supports for orbiting carriers of the slip-feed type are known but such carriers are invariably associated with wire packaging and they employ relatively complicated pinion and ring gear drive arrangements that also are noisy, troublesome and difficult to control.

The sealing mechanisms and systems associated with present day slip-feed carrier type strapping apparatus for applying plastic strapping to packages and friction-fusing the overlapping ends of the strap loop are similar in many respects to the sealing mechanism of the present invention but the similarities are fundamental ones, which is to say that all such mechanisms employ a functionally fixed anvil and a vibrating "hammer" (herein termed vibrator) which cooperates with the anvil and, by its vibratory motion and relatively great pressure of the strap overlap against the anvil, causes the outer overlap layer to frictionally engage the inner layer of the overlap, thus generating sufficient heat of friction to melt the interfacial regions of the two layers and thus fuse them together, all in a well-known manner. The present sealing mechanism embodies a somewhat improved means for projecting the anvil into the path of the strap loop and of withdrawing it from such path at the appropriate time, and an improved means for similarly projecting and withdrawing the strap gripping devices into and out of such strap path. Principally however, the present invention embodies a very materially improved mechanism for effecting vibratory movements of the vibrator as well as for raising and lowering it bodily into and out of engagement with the strap overlap, this latter means being practically silent in its operation as compared to the clattering noise which accompanies the oscillation of conventional vibrators which are used for the same function in connection with slip-feed type strapping machines.

Apart from the above outlined principal advantages that are inherent in the present slip-feed strapping apparatus, a wide variety of less prominent, but nevertheless important, differences from conventional machines of the same type and designed for the same purposes exist. Furthermore, small detailed and novel adjuncts not present in existing machines have been incorporated in the present machine and will subsequently be described, their functions set forth and subsequently claimed.

The provision of a slip-feed type strapping apparatus which is of simplified construction as compared to existing machines designed for the same purpose, and which therefore may be manufactured at a relatively low cost; one which is comprised of a minimum number of parts, particularly moving parts and which therefore is unlikely to get out of order; one which is rugged and durable and which therefore will withstand rough usage; one which is capable of ease of assembly and disassembly for purposes of inspection of parts, replacement or repair; one which requires no particular degree of skill for its operation or maintenance; one which is smooth and silent in its operation; and one which, otherwise, is well adapted to perform the services required of it, are further desirable features which have been borne in mind in the production and development of the present invention.

Numerous other objects and advantages of the invention, not at this time enumerated, will readily suggest themselves as the nature of the invention is better understood.

In the accompanying eight sheets of drawings forming a part of this specification, two illustrative embodiments of the invention have been shown.

Figures 16, 16A:
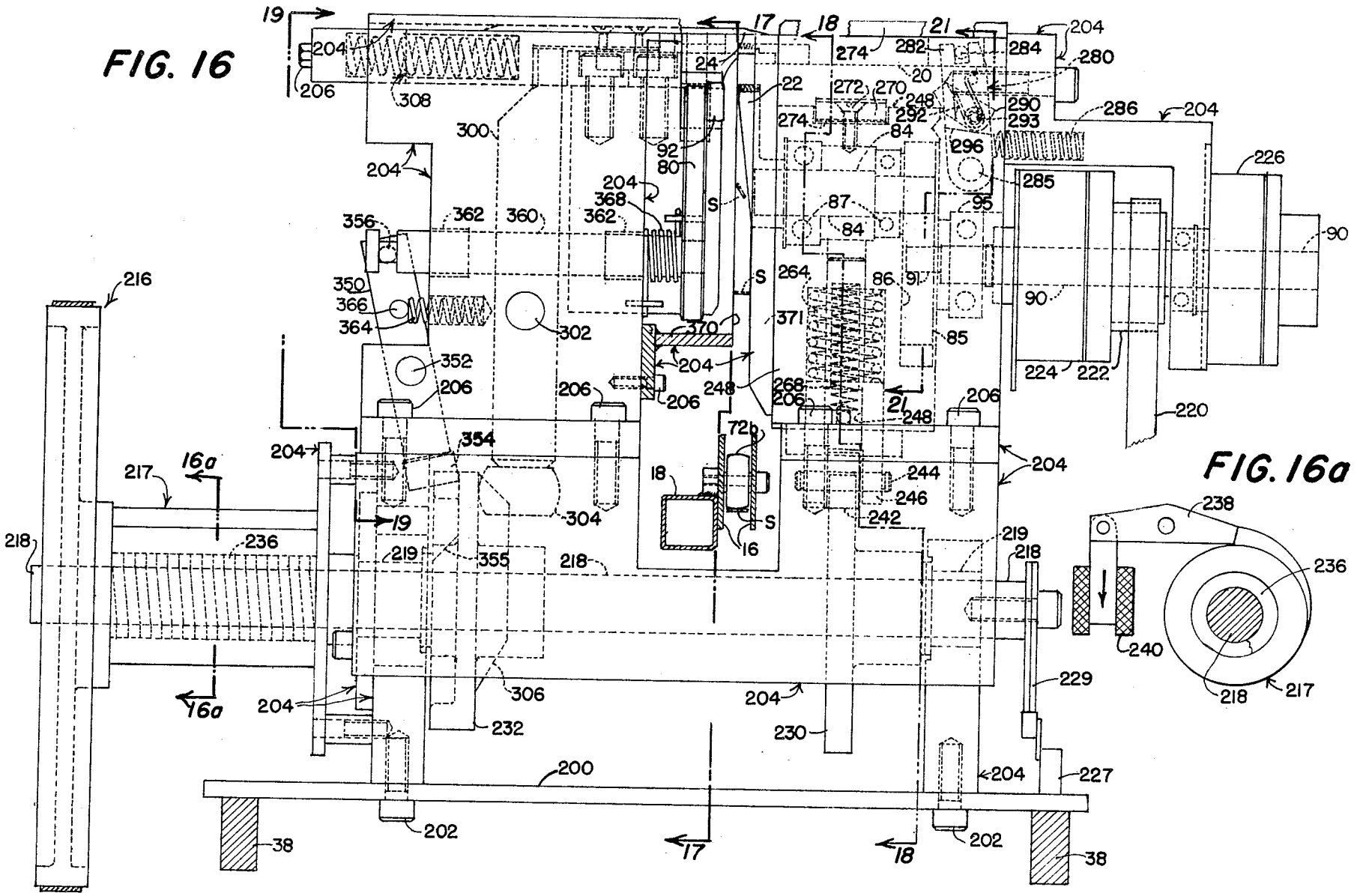
FIG. 16 is an enlarged fragmentary sectional view taken substantially on the line 16—16 of FIG. 1, but showing the sealing mechanism only.
Figure 18:
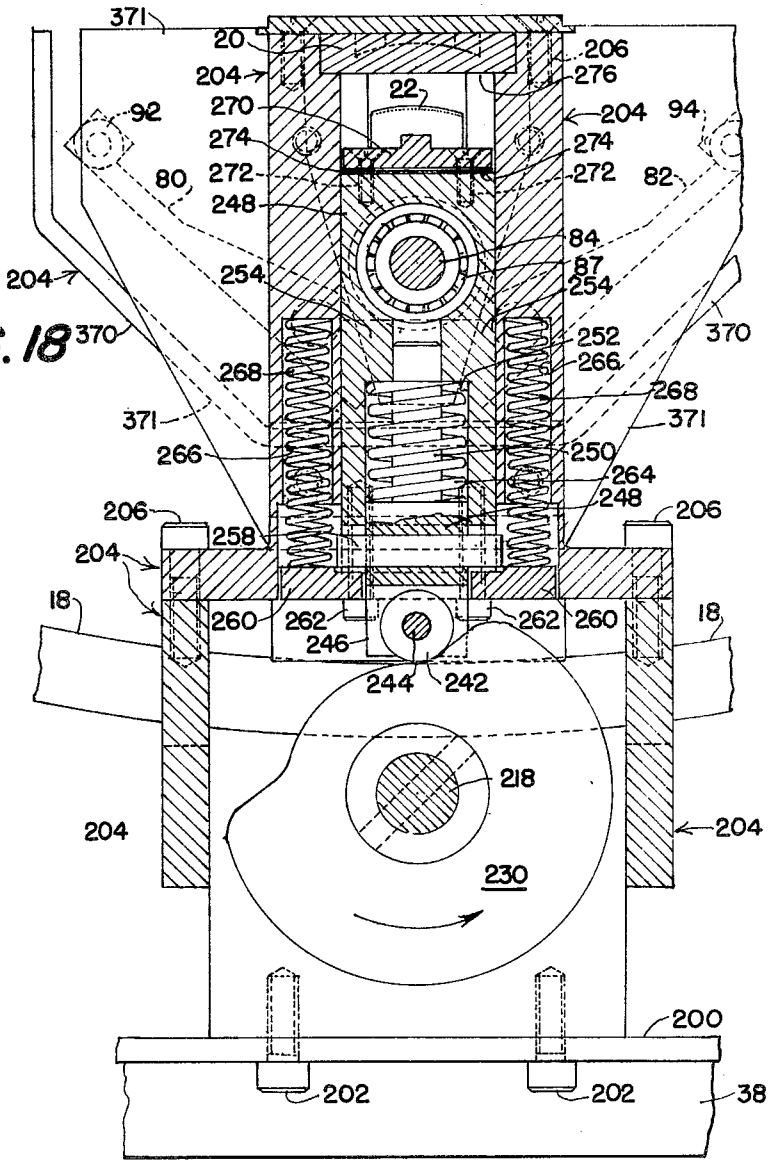
Figure 17:
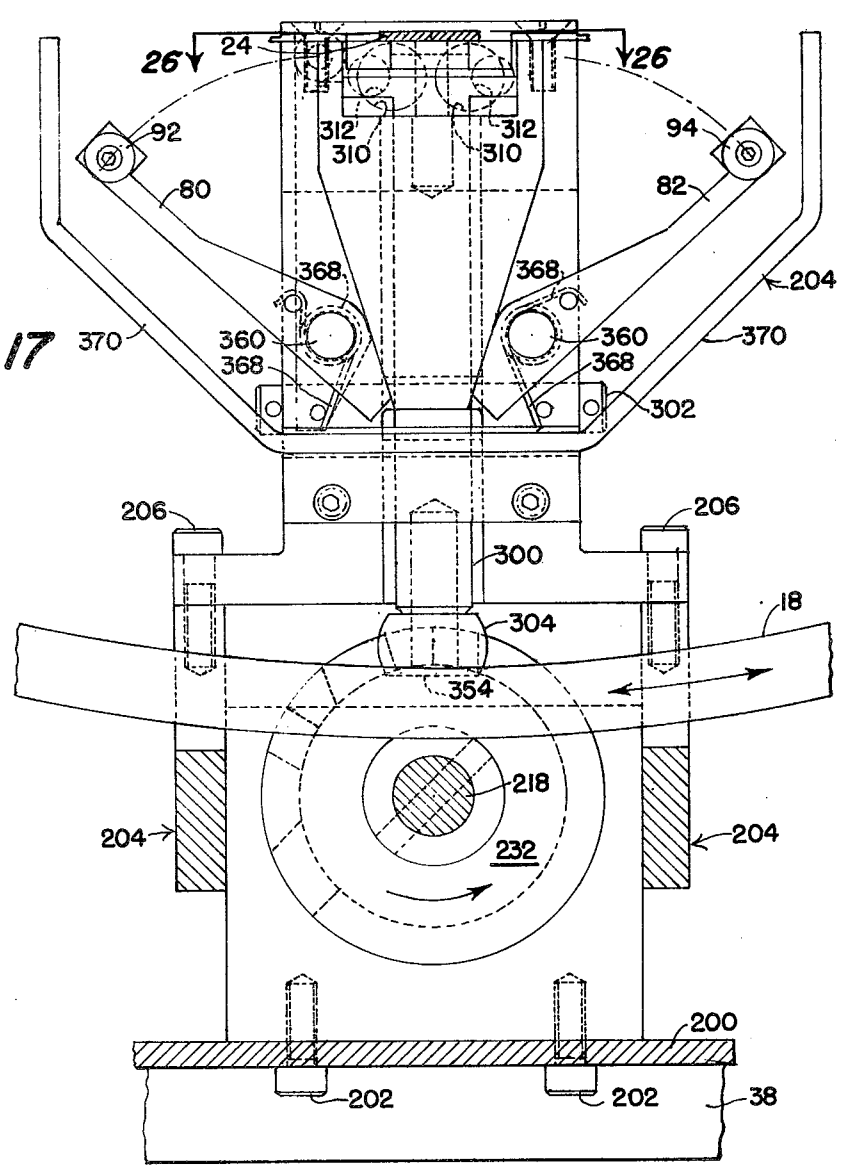
Figure 21:
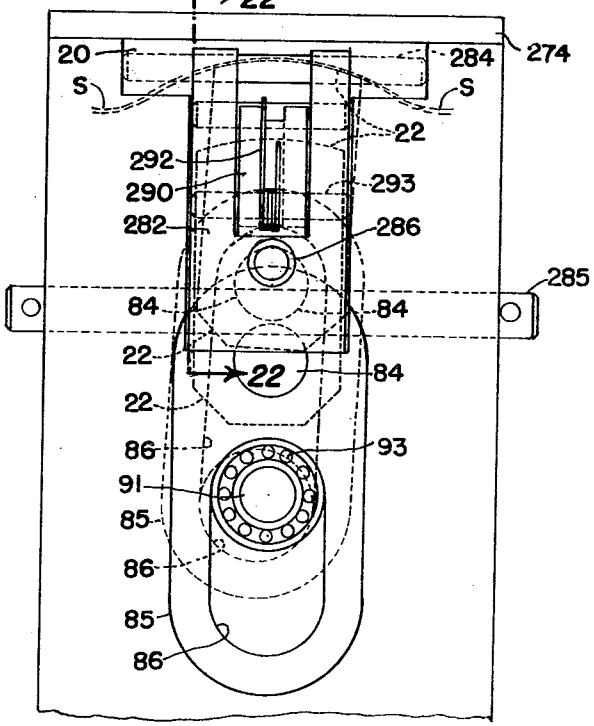
Figure 27:
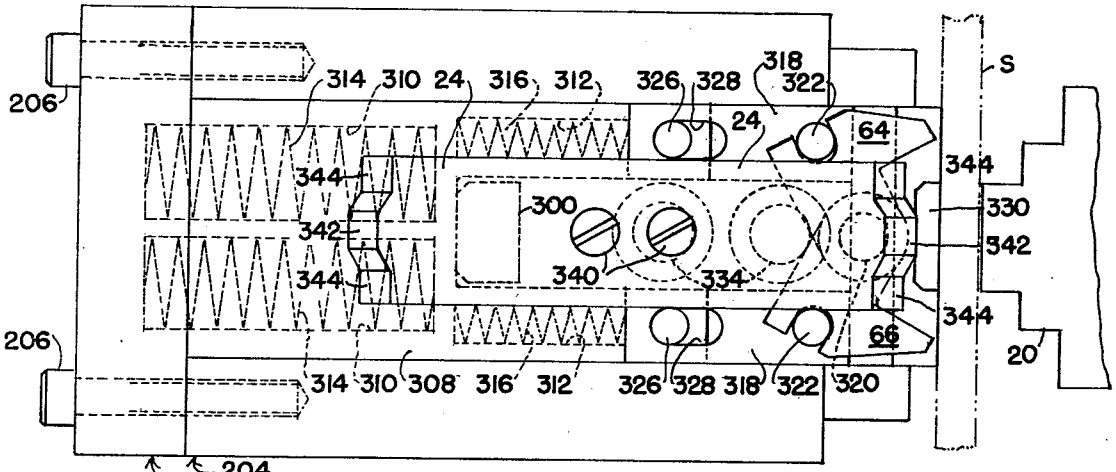
Figure 26:
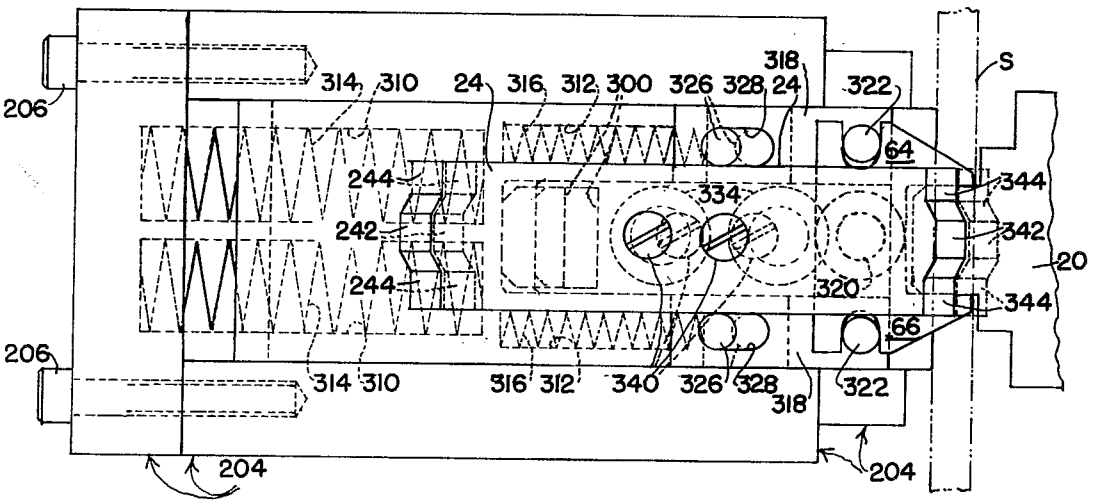

FIG. **16*a* is a sectional view taken substantially on the line 16*a*—16*a* of FIG. 16**;

FIG. 17 is a sectional view taken substantially on the line 17—17 of FIG. 16;

FIG. 18 is a sectional view taken substantially on the line 18—18 of FIG. 16;

FIG. 19 is a sectional view taken substantially on the line 19—19 of FIG. 16;

FIG. 20 is a sectional view taken substantially on the line 20—20 of FIG. 19;

FIG. 21 is a sectional view taken substantially on the line 21—21 of FIG. 16;

FIG. 22 is a sectional view taken substantially on the line 22—22 of FIG. 21;

FIG. 23 is a sectional view, similar to FIG. 22, showing the parts in a different position;

FIG. 24 is a sectional view taken substantially on the line 24—24 of FIG. 20;

FIG. 25 is a sectional view, similar to FIG. 24, showing the parts in a different position;

FIG. 26 is a sectional view taken substantially on the line 26—26 of FIG. 17; and FIG. 27 is a sectional view similar to FIG. 26, showing the parts in a different position.

BRIEF DESCRIPTION

Figure 1:
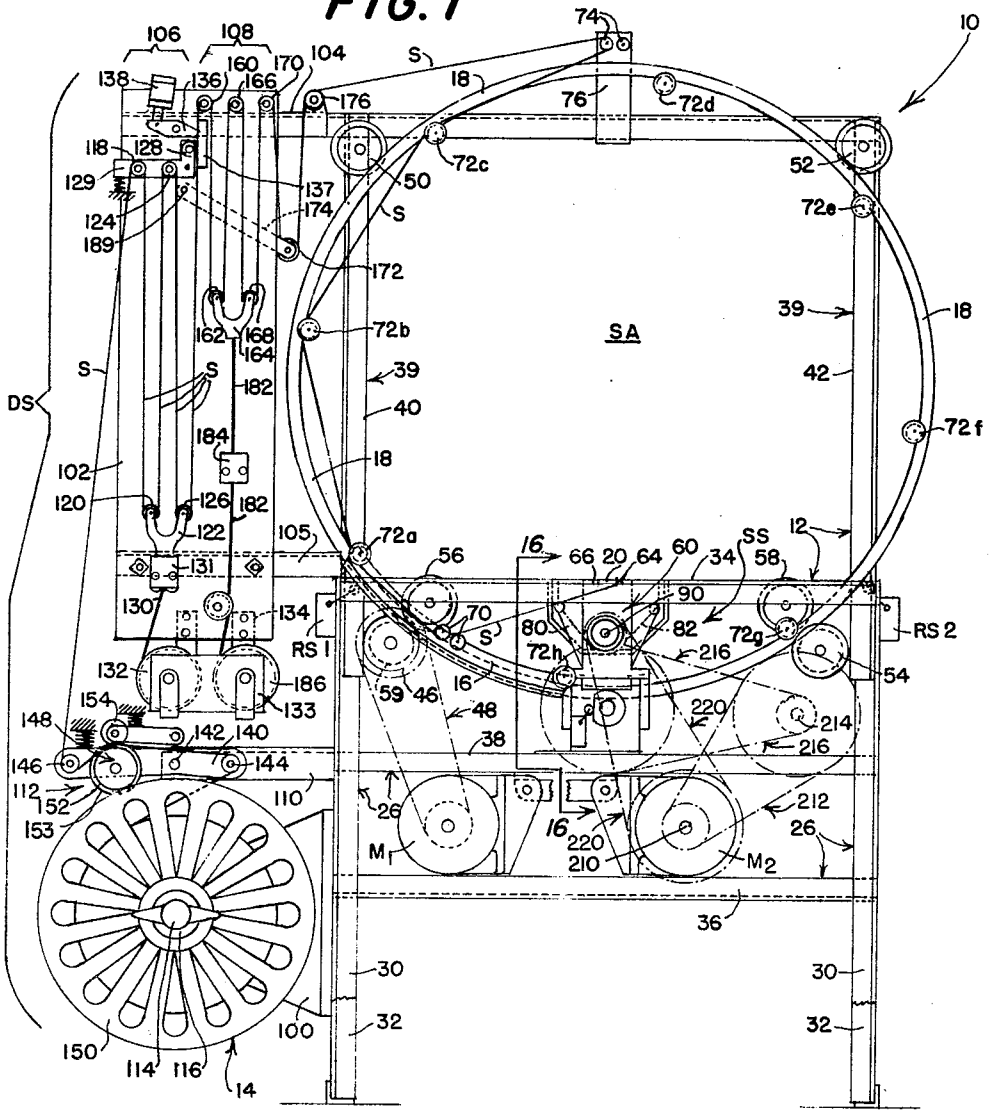
FIG. 1 is a front elevational view of a cyclicly operable strapping machine utilizing a strap dispensing section, a hoop-mounted strap carrier section, and a strap sealing section, the view illustrating the strap carrier in its start position preparatory to reception of a package which is to be strapped at the strapping station of the machine.

Referring now to the drawings in detail, and in particular to FIG. 1, a preferred form of the strapping machine is designated in its entirety by the reference numeral 10 and it involves in its general organization a framework 12 which defines a rectangular shaped strapping area SA designed for reception of a package such as the rectangular box-like package P shown in FIGS. 4 to 13 inclusive. The package P is not necessarily of rectangular design since a wide variety of other package shapes are capable of being accommodated by the present machine and such packages may be brought into strapping position at the strapping area SA for strapping purposes and removed therefrom after the strapping operation has been effected, either manually or by a suitable conveyor or the like (not shown).

At the left hand side of the machine framework 12 as viewed in FIG. 1, there is disposed a strap dispensing storing section DS which includes a strap dispenser or reel 14 from which strapping material S (hereinafter referred to simply as the strap) is fed to a slip-feed carrier 16 which orbits the strapping area SA by means of a reversible rotatable ring or hoop-like motivating member 18 which will hereinafter be referred to simply as the hoop and on which the carrier is peripherally mounted. The strap S issuing from the dispenser reel 14 passes through a strap storing and tensioning mechanism which is embodied in the dispenser section DS and is conducted to the strapping area SA where it is acted upon by the slip-feed carrier 16 during oribital movement of the latter and is thus caused to encircle the package P in a progressive manner and in a clockwise direction until the package is completely surrounded by a closed loop of the strapping and a slight overlap of the strap exists in the vicinity of the bottom region of the hoop 18 and at a sealing station SS.

Sealing instrumentalities, the nature of which will be set forth in detail subsequently, are disposed at the sealing station SS and these include a horizontally slidable but functionally fixed anvil 20 and a cooperating oscillatable sealing member or vibrator 22 (FIGS. 4 through 13). Such sealing instrumentalities operate upon the overlapping portion of the strap loop under pressure in a well-known manner and as exemplified by U.S. Pat. No. 3,548,740, granted on Dec. 22, 1970 and entitled "Strapping Apparatus" and wherein friction-fusion takes place between the overlapping layers of the strap loop overlap. After the strap loop overlap has been thus fused to create a seal, a cutter knife 24 which appears in FIGS. 16, 20, 26 and 27, is actuated to sever the loop from the source of strapping.

After the strap loop, and consequently the package itself, has been severed from the source of strapping, a counterclockwise motion of the hoop takes place and, during such motion, the slip-feed carrier orbits the strapping area SA and returns to its original position. During such counterclockwise orbital motion of the carrier 16 the strap is again wrapped about the package but in a direction opposite to the initial wrap, with substantially the same machine functions taking place and in such a manner that after the strap cut-off operation has been completed, the carrier is restored to its initial position preparatory to the performance of another machine cycle, all in a manner that will be described in detail presently.

DETAILED DESCRIPTION

(General Considerations)

Still referring to FIG. 1, and bearing in mind that this view is somewhat schematic in its representation, the aforementioned framework 12 includes a relatively thin table or base structure 26 embodying front and rear corner posts 30 and 32 which serve to support an upper table proper 34. Lower anglepieces 36 and intermediate frame bars 38 (see also FIG. 16) extend across the base structure 36. Projecting upwardly from the base structure 26 and above the table 34 is an inverted rectilinear U-shaped frame 39 including vertical side members 40 and 42 and a horizontal top member 44, such frame, in combination with the top shelf or table 34 encompassing the strapping area SA, where a package such as the package P shown in FIGS. 4 to 13 inclusive may rest upon the table 34.

The hoop 18 is mounted on the framework 12 for alternate cycles of rotation in opposite directions under the influence of a reversible electric motor M1 (hereinafter referred to as the hoop motor), such motor being suitably mounted on the framework 12 and being operatively connected in driving relationship to a friction drive roller 46 by means of a belt and pulley arrangement 48. The drive roller 46 functions as one of four outside quadrilaterally arranged centering rollers including additional rollers 50, 52 and 54 by means of which the hoop 18 is confined in its rotational movement, the three other rollers being equally spaced around the periphery of the hoop 18. The two rollers 46 and 54 cooperate with inside backing rollers 56 and 58 respectively. The friction drive roller 46 has associated therewith a braking mechanism 59.

As will also be described in greater detail subsequently, a sealing mechanism 60 is disposed in the vicinity of the strapping station SS such mechanism embodying the aforementioned anvil 20 (see also FIGS. 4 through 13 inclusive) and a pair of cooperating grippers 64 and 66 on opposite sides thereof. The gripper 64 cooperates with the right hand side of the anvil 20 to clamp the free end of the strap S during clockwise wrapping of the strap about the package P, while the gripper 66 cooperates with the left hand side of the anvil 20 to similarly clamp the free end of the strap during counterclockwise wrapping of the package.

(Package Wrapping Operations)

FIGS. 1 and 4 through 7 are sequence views illustrating the motion of the hoop 18 and its associated carrier 16 during clockwise draping of the strap S about a package such as the package P. FIG. 1 represents the starting position of the strapping machine wherein the right hand gripper 64 clamps the free end of the strap S against the anvil 20 and the strap passes between a pair of draping slip rollers 70 which are mounted on the carrier. In this start position of the machine, the carrier assumes approximately a seven o'clock position relative to the circumference of the hoop 18. From the draping slip rollers 70, the strap passes around three of a series of eight equally and circumferentially spaced grooved spreader rollers 72 which are rotatably mounted on the hoop 18 and from the last of these three rollers 72, the strap passes between a pair of slightly spaced apart centering rollers 74 which are carried on an upstanding bracket 76 attached to the top member 44 of the inverted U-shaped frame 39 and through which centering rollers the strapping passes in slip feed relationship. Although the centering rollers 74 are shown as being disposed at twelve o'clock position relative to the hoop 18, they are not necessarily so disposed. From the centering rollers 74, the strap S passes into a strap storing and tensioning section of the dispensing section DS and is operated upon variously as the hoop 18 continues its rotation, all in a manner that will be made clear when the nature of the invention is better understood.

Figure 4:
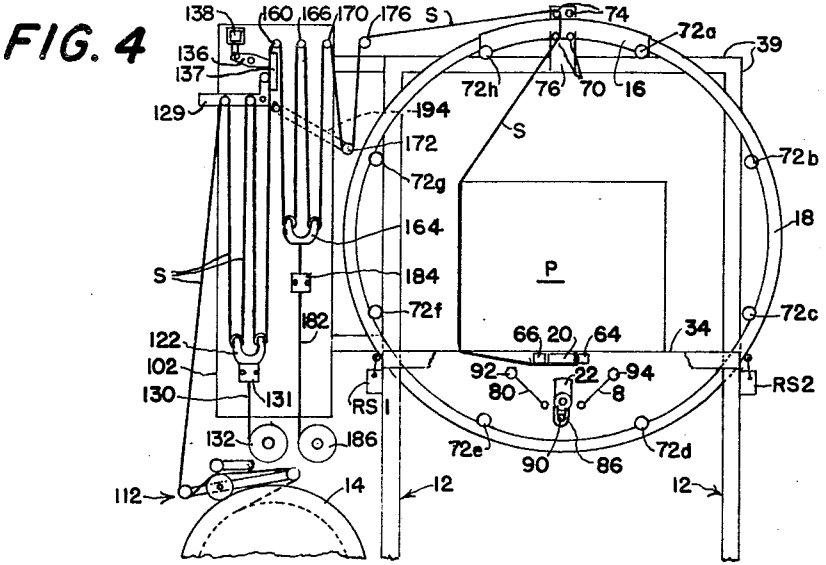
FIG. 4 is a fragmentary front elevational view, largely schematic in its representation, showing the free end of the banding strip gripped, and the carrier in the position which it assumes shortly after one face of a rectangular package has been wrapped in a clockwise direction.

Referring now additionally to FIG. 4 wherein the hoop 18 has been rotated in a clockwise direction to a position where the carrier 16 assumes an approximate twelve o'clock position immediately below the centering rollers 74, it will be noted that the various spreader rollers 72 have been sequentially labelled in a clockwise direction from 72*a* to 72*h* and that at this point in the clockwise cycle of hoop motion the aforementioned spreader rollers 72*a*, 72*b* and 72*c* have moved away from the strap and thus released the same so as to allow a limited portion of the strapping material to be fed through the centering rollers 74 back into the dispensing section DS. At the same time, the carrier mounted draping rollers 70 serve to pull the strap inwardly, i.e. to the right as viewed in FIG. 4, toward the package which has now been positioned within the strapping area SA so that it rests upon the table 34. The strap is thus caused to become wrapped upon the left hand side of the package P and the tension maintained by the strap storing and dispensing mechanism is sufficiently low that although the strap is drawn taut, it is not so great as to displace the loosely positioned package from its normal degree of stable equilibrium on the table 34. The manner in which such initial wrapping tension is maintained in the strap S will be described in detail when the nature of the dispensing section is subsequently set forth.

Figure 5:
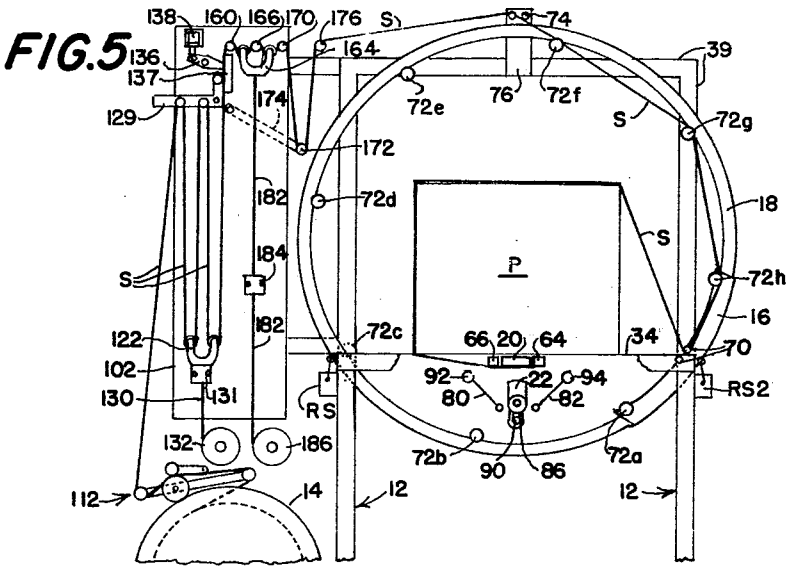
FIG. 5 is a front elevational view, similar to FIG. 4, showing the carrier in the position which it assumes shortly after two faces of the package have been wrapped.

As shown in FIG. 5, wherein continued clockwise motion of the hoop 18 has shifted the carrier to approximately a four o'clock position, the initial motion of the carrier away from its twelve o'clock position causes the draping rollers 70 to commence pulling the strap material out of the dispensing section while the latter still maintains the necessary tension in the strap so as not to displace the package. As the carrier 16 arrives at the aforementioned four o'clock position an appreciable quantity of strap has thus been withdrawn from the dispensing section and applied to the package so that, at this time, two faces of the package P have been wrapped or banded. It is to be particularly noted at this point that while the draping rollers 70 on the carrier 16 continue to wrap the strap about the package P, the spreader rollers 72*h*, 72*g* and 72*f* pick up the strap issuing from the centering rollers 74 successively and in the order named so that an outside length of strapping material is brought around the partially banded package in a clockwise direction preparatory to a subsequent cycle of counterclockwise wrapping of the latter in a manner that will be described presently.

Figure 6:
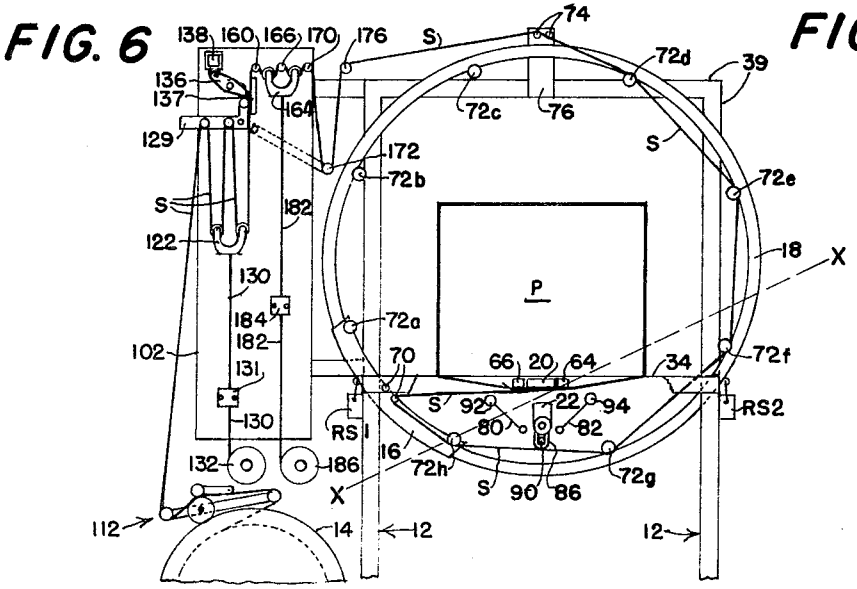
FIG. 6 is a front elevational view, similar to FIG. 5, showing the carrier in the position which it assumes shortly after the strap has been completely wrapped about the package.

In FIG. 6 continued clockwise motion of the hoop 18 has shifted the carrier 16 from the four o'clock position of FIG. 5 to an approximate seven o'clock position wherein the draping rollers 70 of the carrier have pulled the strap against the right hand side of the package and also have brought the strap beneath the anvil 20 and its associated grippers 64 and 66 so that the package is now completely encompassed by a closed loop of strapping material. As the strapping material passes beneath the anvil 20 it establishes a loop overlap which subsequently becomes friction-fused at the strapping station SS under the influence of the sealing member or vibrator 22 in a manner that will become clear presently. At the same time, the spreader rollers 72*d*, 72*e*, 72*f*, 72*g* and 72*h* have increased the extent of the outside length of strapping which has partially encompassed the strapping area SA.

It has been previously stated that the dispenser mechanism DS has facilities for maintaining a degree of initial banding tension upon the strapping material and, as will be explained presently, this application of initial tension remains prevalent upon the strapping material while the carrier mounted draping rollers 70 pull the strap over three faces of the package and also until such time as the second strap layer is pulled beneath the anvil 20 to establish the aforementioned strap overlap as illustrated in FIG. 6. Immediately thereafter a slight amount of further clockwise rotation brings the carrier 16 to an approximate seven-thirty o'clock position as shown in FIG. 7 where the draping rollers 70 lie slightly above the level of the table 34 with the consequence that the two layers of the strap overlap are firmly pressed upwardly against the underneath side of the anvil 20 with the gripper 64 still clamping the free end of the strap loop against the right hand side of the anvil.

Figure 7:
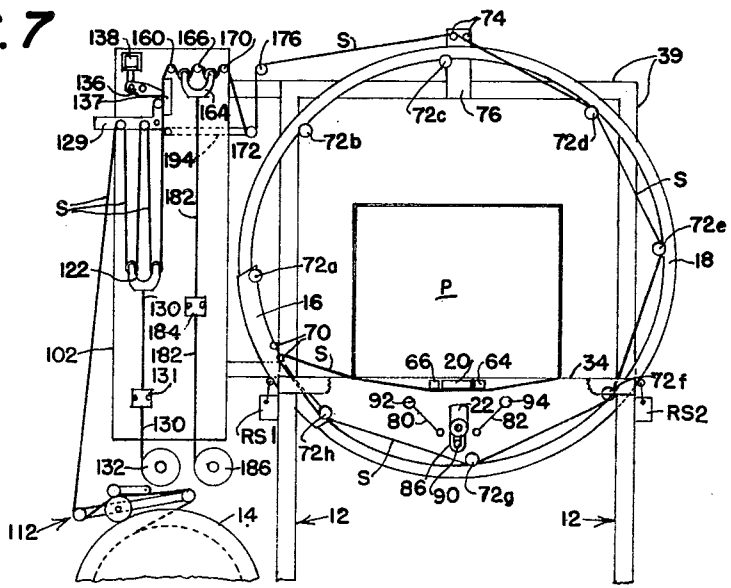
FIG. 7 is a schematic view similar to FIG. 6, showing the carrier in a position of rest at a point near the end of its clockwise motion.
Figure 8:
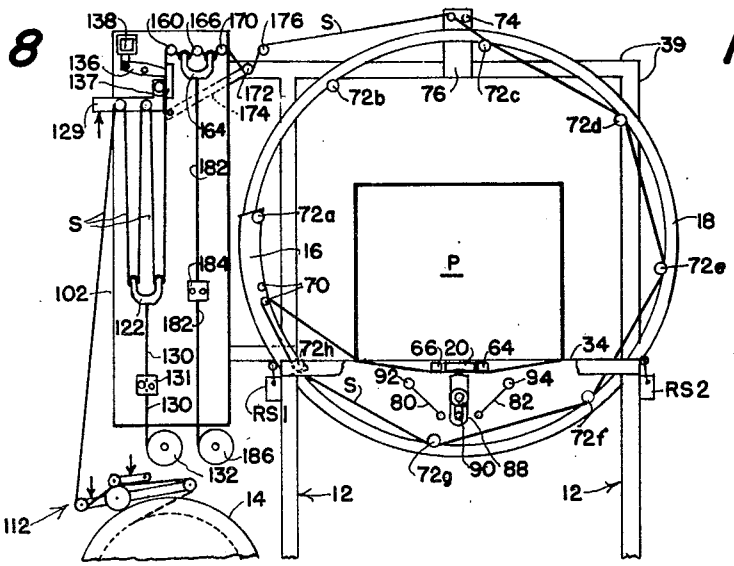
FIG. 8 is a schematic view, similar to FIG. 7, showing the carrier at the end of its clockwise motion and illustrating the manner in which final tension is applied to the strap immediately prior to the sealing operation by means of which the overlapping portions of the strap are sealed together.

In FIG. 8, a further small increment of clockwise motion has brought the carrier 16 to a terminal approximately eight-thirty o'clock position and in thus moving from its approximate seven-thirty o'clock position of FIG. 7, the pull on the strap S which is exerted represents a final and more positive or stronger tensional pull of the strapping which exceeds the former relatively light wrapping tension which was applied during movement of the carrier 16 from its starting position to its seven-thirty o'clock position. Such excess or final tension is a result of functions which take place in the dispensing section DS as will be set forth when the nature of such dispensing section is set forth. This additional final tension slides the strapping endwise around all four corners of the package and determines the ultimate banding pressure on the package at the time the strap overlap is sealed.

Figure 9:
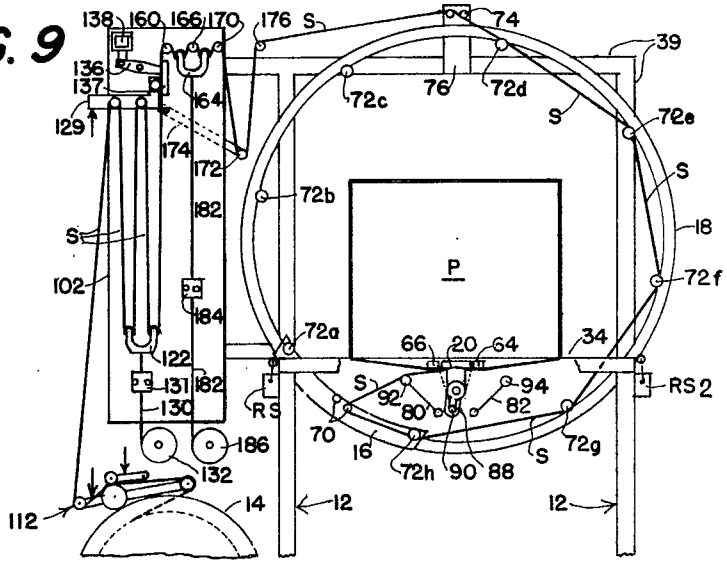
FIG. 9 is a schematic view, similar to FIG. 8, showing the carrier at the commencement of its counterclockwise motion and also showing the sealing operation in progress.

As has been previously mentioned, and as will be described in detail subsequently, with reference to FIGS. 16 through 27, the anvil 20 and its associated right and left hand grippers 64 and 66 at the sealing station SS are horizontally slidable in a fore and aft direction between retracted positions behind the general plane of the strap loop and advanced or projected positions where they become projected between the strap overlap and the underneath side of the package P. Heretofore, i.e. in the sequence of operations which takes place in the disclosures of FIGS. 1 and 4 through 8, both the anvil 20 and the grippers 64 and 66 remain disposed in their projected positions. The aformentioned sealing member or vibrator 22 is shiftable vertically from the lowered inoperative position in which it is illustrated in FIGS. 1 and 4 through 8, and a raised operative position in which it is shown in FIG. 9, this latter view representing the sealing operation which is performed upon the loop overlap. Also horizontally shiftable at the sealing station SS are a pair of spring-biased pivoted direction-reversing lift fingers 80 and 82 which, during the portion of the clockwise wrapping cycle illustrated in FIGS. 1 and 4 through 8, assume positions rearwardly and out of the path of the strap S which is being applied to the package P. However, immediately after the carrier 16 reaches the eight-thirty o'clock position in which it is shown in FIG. 8, reversal of the hoop 18 takes place and at this time the lift fingers become projected into the path of subsequent movement of the strap so that as the carrier passes downwardly toward the six o'clock position thereof, the strap is brought into contact with the finger 80 as shown in FIG. 9.

During this reverse downward arcuate movement of the carrier 16, the sealing member or vibrator 22, which heretofore has remained stationary and in the lowered position thereof commences to vibrate and at the same time to rise toward its sealing position in cooperation with the anvil 20. In its uppermost vibrating position, the serrated upper edge (see also FIG. 21) of the vibrator 20 engages the outer layer of the loop overlap and presses it against the inner layer of the overlap which is held motionless by the serrated underneath side of the anvil 20, while at the same time sliding such outer layer back and forth against the inner layer with a high degree of pressure and at a rapid speed so as to make a joint or seal by the friction-fusion technique which is described in United States patent to Stensaker U.S. Pat. No. 3,442,735, granted on May 6, 1965 and entitled "Friction Fusion Strap Sealing" and also in United States patent to Kobiella U.S. Pat. No. 3,494,280, granted on Feb. 10, 1970 and entitled "Torsion Bar Sealing Mechanism."

It should be borne in mind that the disclosures of FIGS. 1 and 4 through 13 are largely schematic in their representation and do not illustrate the details of the anvil 20, its associated grippers 64 and 66, the lift fingers 80 and 82, or the manner in which these instrumentalities are activated or otherwise caused to cooperate with one another during normal functioning of the strapping apparatus. Their nature and manner of operation will be set forth in considerable detail presently and in connection with FIGS. 16 through 26 but for the present, it is deemed sufficient to point out that the vibrator 22 is roughly similar in configuration and function to a vibrator which appears in the aforementioned Kobiella patent U.S. Pat. No. 3,494,280 and which is referred to in such patent as a vibrating hammer.

The vibrator 22 does not appear in FIG. 1 and it is shown only schematically in FIGS. 4 through 13. However it also appears in FIGS. 16 and 18 and it is shown in detail in FIG. 21. Such vibrator is in the form of an oscillatable arm, the proximate lower end of which is fixedly secured to the rear end of a rapidly oscillating horizontal rock shaft 84 (FIG. 16) so that the vibrator oscillates in unison with the rock shaft throughout a small arc of swinging movement. The front end of the rock shaft 84 has fixedly secured thereto the upper proximate end of a slotted crank arm 85 (see also FIG. 21) within which there is disposed an elongated axial slot 86. The rock shaft 84 is suitably mounted in bearings 87 supported by the framework 12. A horizontal eccentric shaft 90 carries an offset eccentric proper 91 which is encompassed by a roller bearing 93 (FIG. 21) that rides in the slot 86. The eccentric shaft 90 is rotatably supported in bearings 95 in the framework 12. It will be seen therefore that upon rotation of the eccentric shaft 90, oscillation will be applied to the slotted crank arm 85 and also to the rock shaft 84, thereby vibrating (oscillating) the vibrator 22. As will become more readily apparent when the nature of the entire sealing mechanism 60 is fully described in connection with FIGS. 16, 17, 18 and 21, the vibrator 22 normally remains in its lowered position wherein it is shown in full lines in FIGS. 16 and 21 and, at this time, it does not vibrate. It is only when the vibrator is shifted to its upper position as shown in dotted lines in these views that vibration takes place. It is deemed sufficient for the moment to state that the vibrator 22 and the rock shaft 84, together with the slotted crank arm 85, are shiftable bodily in unison vertically to bring the vibrator 22 into and out of cooperation with the anvil 20, thereby shifting the relationship between the slot 86 (FIG. 21) and its associated offset eccentric 91. In the interests of simplicity, in the schematic views of FIGS. 4 through 13, only the vibrator 22, rock shaft 84 and eccentric proper 91 are disclosed.

Figure 10:
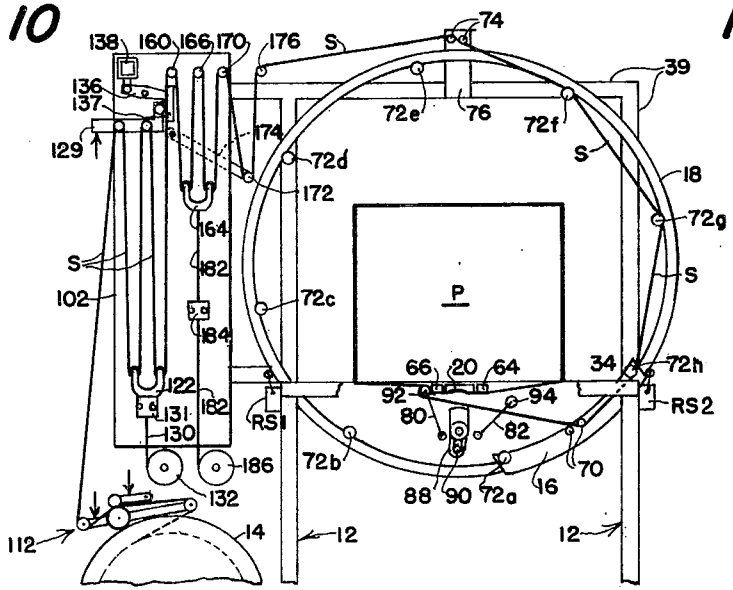
FIG. 10 is a schematic view, similar to FIG. 9, showing the termination of the sealing operation during continuation of the counterclockwise motion of the carrier.

In FIG. 10, the carrier 16 is shown as having moved further in its counterclockwise direction with the anvil 20 and its associated grippers 64 and 66 still in their advanced position between the fused strap seal or joint and the underneath side of the package P, the carrier assuming an approximate five o'clock position. During this carrier movement, the vibrator 22 has been returned to its lowered inoperative position while the strap S has been pulled, so to speak, around a small roller 92 (see also FIGS. 17 and 19) which is mounted on the distal end of the lift finger 80, thus reversing the strap S and commencing the counterclockwise wrapping operation thereof about the package P, while at the same time raising the finger to the position shown in FIG. 10.

Figure 11:
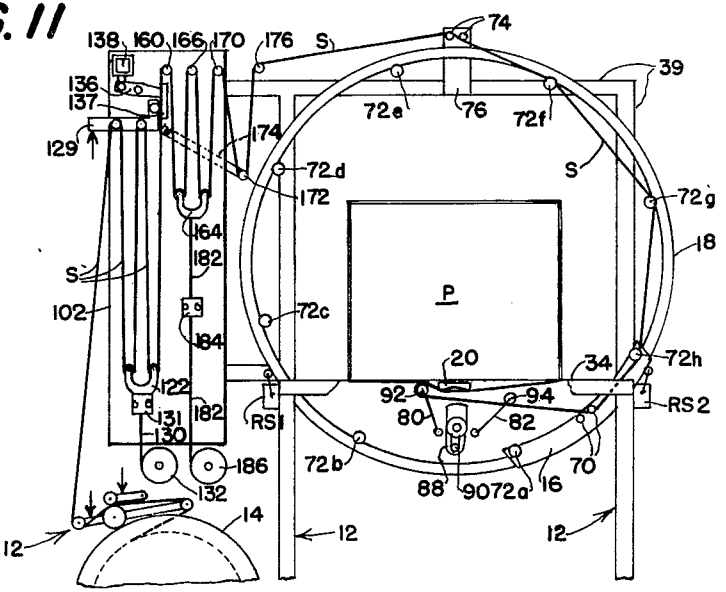
FIG. 11 is a schematic view, similar to FIG. 10, showing the carrier in a position of rest preparatory to complete withdrawal of the sealing instrumentalities from the sealed portion of the strap loop.

In FIG. 11, the carrier 16 has shifted throughout a small arc in its counterclockwise motion so that it assumes an approximately four-thirty o'clock position and, at this time, the two grippers 64 and 66 have been retracted rearwardly, leaving the anvil interposed between the overlap joint and the package and bringing the strap S into contact with a roller 94 which is provided on the distal end of the lift finger 82.

Figure 12:
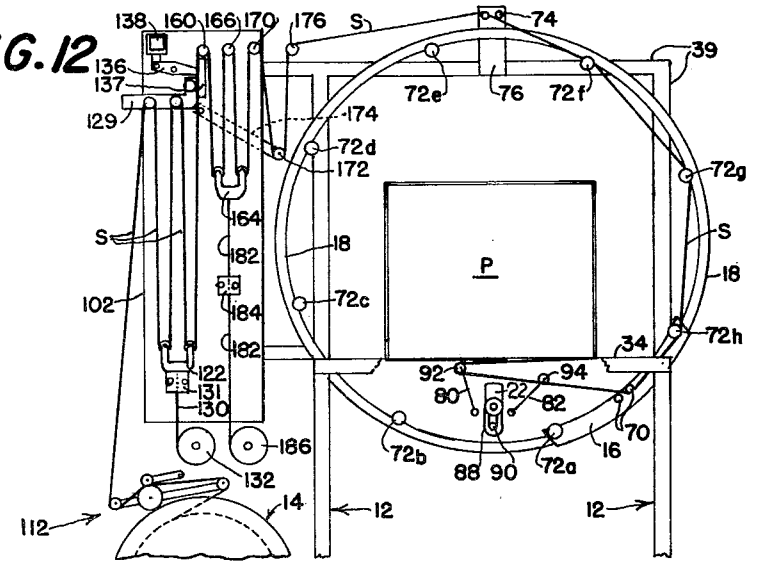
FIG. 12 is a schematic view, similar to FIG. 11, showing the sealing and gripping instrumentalities withdrawn from the sealed portion of the strap loop.

In FIG. 12, the carrier 16 has progressed in a counterclockwise direction to approximately a four-thirty o'clock position where it remains momentarily stationary due to a short dwell period of the hoop 18 under the influence of a timer (not shown herein) the function of which dwell will be explained presently. Also at this time the anvil 20 shifts forwardly to its retracted position where it is withdrawn from the strap seal, thus allowing the tensioned strap loop to cause the fused seal to snap upwardly into contact with the now fully strapped package P.

Figure 13:
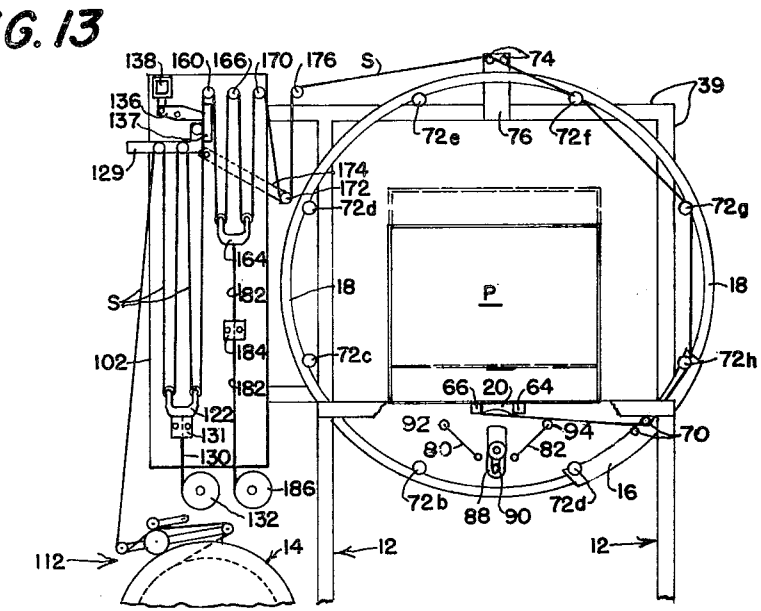
FIG. 13 is a schematic view, similar to FIG. 12, showing the strap loop severed from the source of strapping, and the free end of the strap gripped while counterclockwise motion of the carrier is resumed preparatory to banding of the package in a counterclockwise direction.

In FIG. 13, a slight continued counterclockwise motion of the carrier 16 to approximately its four o'clock position, accompanied by retraction of the two spring-biased lift fingers 80 and 82 rearwardly, releases the rollers 92 and 94 from the strap S so hat the lift finger 80 returns to its lowered position while the roller 94 on the arm 82 now lies beneath the strap. Additionally, at this time, the anvil 20 and its associated grippers 64 and 66 again become projected rearwardly so that they underlie the fully wrapped package P. At this time, the left hand gripper is moved to its strap-clamping position relative to the anvil 20, thus occupying the position from which the finger roller 92 has just moved and, immediately thereafter, a cut-off knife 96 which does not appear in the schematic views of FIGS. 1 and 4 through 13 but which does appear in FIGS. 16 and 27, passes across the sealing station immediately beneath the package P and severs the excess strapping exclusive of the clamped portion thereof and thus frees the strapped package from the source of strapping so that it may be removed from the strapping area or shifted to a new position preparatory to banding of the package in a counterclockwise direction. Such withdrawal of the package P is illustrated in dotted lines in FIG. 13.

The hoop 18 and associated carrier 16 continued their counterclockwise motion and the carrier 16 is ultimately brought to its initial starting position wherein it is illustrated in FIG. 1. During such counterclockwise rotation, a sequence of package banding or wrapping functions similar to those heretofore described in connection with the clockwise banding of the package and sequentially portrayed in FIGS. 1 and 4 through 13 takes place. It is not deemed necessary to describe all of these functions in detail, it being sufficient to state that as the carrier rollers shift the strapping inwardly toward the package in wrap-around fashion, a portion of the strap which bears against the spreader rollers 72*e*, 72*f*, 72*g* and 72*h*, less such portion of the strap as is applied to the package, is returned to the tensioning and storing mechanism of the dispenser section DS and, at this time, the draping rollers 70 will lie directly beneath the centering rollers 74 with the various parts assuming the positions in which they are shown in FIG. 4 but with the strap S being wrapped against the right hand side of the package P instead of the left hand side. A series of substantially mirror-views of front FIGS. 5 to 13 inclusive would represent the counterclockwise sequence of banding the package P in a counterclockwise direction as well as of effecting the friction fusion and strap cut-off operations. It will be understood of course that shortly after the carrier 16 passes the centering rollers 74 in its counterclockwise movement, the strapping material is again withdrawn from the dispenser section DS for application to the left hand side of the package P. It will also be understood that during the counterclockwise movement of the carrier 16, the roller 94 on the lift finger 82 will supplant the roller 92 on the lift finger 80 in preparing the machine for the next clockwise package wrapping cycle. It should be borne in mind that during the first portion of the counterclockwise wrapping operation, the aforementioned outside length of strapping which was created by the spreader rollers 72*f*, 72*g*, and 72*h* are instrumental in effecting the strap return to the dispenser section DS.

(Strap Dispensing Operations)

Figure 2:
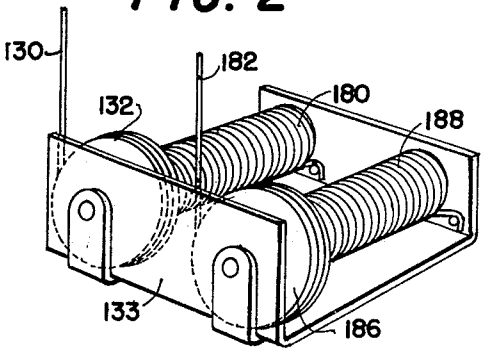
FIG. 2 is an enlarged fragmentary front perspective view of a portion of the dispensing section of FIG. 1, the view representing a spring and cable feed-out cluster which is employed in connection with the application of initial tension to a banding strip which is to be applied to the package.
Figure 3:
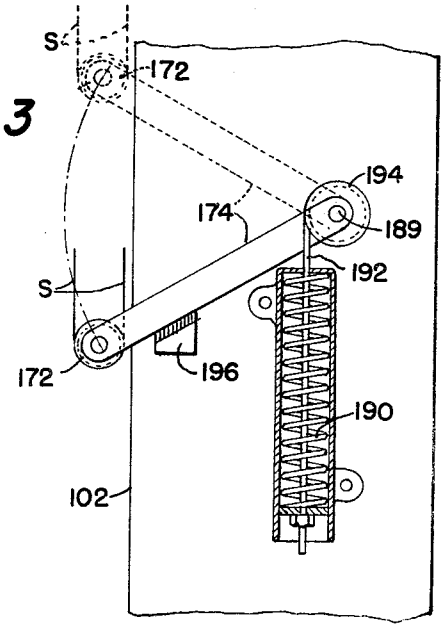
FIG. 3 is an enlarged fragmentary rear view of another portion of the dispensing section shown in FIG. 1, the view representing a tensioning arm and its associated biasing spring by means of which final tension is applied to the banding strap after a complete loop has been drawn and thus wrapped about the package.

Referring again to FIG. 1, and additionally to FIGS. 2 and 3, wherein the nature of the strap dispensing and staring section DS is best illustrated, this section includes the aforementioned dispenser spool or reel 14 which is carried on a bracket 100 and the aforementioned strap storage mechanism which, in the main, is supported upon a backing plate 102 which, in turn, is supported by upper and lower anglepieces 104 and 105 respectively. The backing plate 102 is vertically elongated and the left hand side region of such plate, which is designated by the bracket 106 defines what is termed herein as a secondary strap storage region, while the right hand side of the plate which is designated by the bracket 108 defines what is termed herein as a primary strap storage region. Suitably supported on an anglepiece 110 is a strap snubbing mechanism which has been designated in its entirety by the reference numeral 112 such mechanism being disposed a slight distance below the lower end of the backing plate 102. The function of the strap snubbing mechanism is to assimilate any looseness in the strap between such roller and the reel in the event that the reel tends to overrun the strap feed-out operation.

Except for a slight frictional drag which is exerted upon the strap dispenser reel 14, such reel is freely rotatable on a central shaft 114 and it consists of a central hub 116 on which the strapping material is involutely wound. From the reel, the strap passes through the snubbing mechanism 112 and from thence it extends upwardly where it enters a first pulley system which is associated with the previously mentioned strap storage region 106. Upon entering such pulley system the strap passes around a pulley 118 and from thence downwardly and around a pulley 120 which is carried on a vertically shiftable yoke 122 associated with the secondary storage system 106. The strap then passes upwardly and around a pulley 124 and then downwardly and around a second pulley 126 associated with the vertically shiftable yoke 122, after which it extends upwardly and past a pinch or drag roller 128 carried on a spring biased arm 129 and which cooperates with a fixed snubbing bar 137. From the roller 128 the strap passes into a roller system associated with the primary strap storage region 108.

The aforementioned yoke 122 with its two rollers 120 and 126 are thus suspended from two loops or bights of strapping and the base of the yoke is connected to a cable 130 which extends through a cable guide and yoke stop abutment 131 and is fixed to a spring-biased drum 132 (see also FIG. 2) carried in a cradle 133 which is suspended by brackets 134 from the plate 102. A self-energizing spring-biased locking lever 136 immediately above the pinch roller 128 normally cooperates with a fixed reaction bar 137 to prevent pulling of the strapping from the pulley system of the secondary storage system 106. A solenoid 138 is effective upon energization thereof to release the locking lever 136.

Considering now the nature of the aforementioned strap storage mechanism 106 and the strap snubbing mechanism 112, the dispenser reel 14 is possessed of a considerable degree of inertia and therefore after it has commenced to rotate when strap is drawn therefrom, there is danger of the reel overrunning the strap when the demand for strap decreases. Also when the reel 14 is stationary and there is a sudden requirement for strapping, a direct pull of strapping from the coil in an effort to overcome the inertia of the coil would create such a heavy tension in the strap that the package P might become unseated from its position of stable equilibrium on the table 34.

The snubber mechanism involves in its general organization a spring-biased lever-like arm 140 which is pivoted at 142 to the anklepiece 110 medially of its ends for limited rocking movement. The arm 140 carries a pair of strap guiding rollers 144 and 146 at its opposite ends, and a medial compound roller 148. The strap spool or dispenser 14 embodies a drum upon which the strapping is involutely wound and a pair of side flanges 150. The compound roller 148 includes a pair of outside small diameter friction rollers 152 which ride on the rims of the side flanges 150, and a central larger diameter grooved pinch roller 153 which cooperates with a spring biased pinch roller 154 for strap snubbing purposes. Strapping which is pulled from the dispenser reel 14 passes around the roller 144, between the pinch rollers 153 and 154 and then beneath the roller 146, successively and in the order named, and from thence upwardly to the pulley 118. Since the small rollers 152 ride on the flanges 150 of the strap reel 14, the larger grooved strap roller 153 assimilates any looseness in the strap between such roller and the reel in the event that the reel tends to overrun the strap feedout operation. It is to be noted at this point that when tension is applied to the strap S an upward force is applied to the roller 146 which tends to raise the compound roller 148 away from the strap reel 14 and thus reduce the effort which is required to move the latter.

Still referring to FIG. 1, strap S which thus far has been traced through the strap pay-out section 106 of the dispenser system DS passes from the roller 126 of the yoke 122 to a fixed roller 160 and from thence downwardly and around a roller 162 carried on a second yoke 164, similar to the yoke 122. The strap then passes upwardly and around another fixed roller 166 and extends downwardly and around a roller 168 also carried by the yoke 164 from whence it passes upwardly and around a third fixed roller 170. From the roller 170, the strap passes downwardly and around a roller 172 mounted on the distal end of a final tensioning arm 174 (see also FIG. 3) and then upwardly around a fourth fixed roller 176. The four fixed rollers 160, 166, 170 and 176 are all in substantially horizontal alignment and they are staggered relative to the shiftable rollers 120, 126, 162 and 168. The strap then passes to the centering rollers 74 associated with the previously described hoop wrapping system.

Referring again to FIG. 2, the aforementioned drum 132 for the cable 130 is spring biased in a counterclockwise direction by means of a torsion coil spring 180 associated with the cradle 133 so that a downward bias is at all times applied to the yoke 122 (FIG. 1). In a similar manner, the yoke 164 is attached to a cable 182 which passes through an abutment 184 and is affixed to a drum 186 which also is spring biased in a counterclockwise direction by means of a torsion spring 188 associated with the cradle 133.

As shown in FIG. 3, the aforementioned final tensioning arm 174 is pivoted as at 189 to the backing plate 102 and is spring biased in a counterclockwise direction (clockwise as viewed in FIG. 1) by means of a relatively heavy or strong shielded compression spring 190, which exerts a downward swinging bias to the arm through the medium of a pull cable 192 and pulley 194, thus forcing the pulley 172 (FIG. 1) downwardly into the bight portion of the strap S with appreciable pressure. A stop 196 limits the downward swinging movement of the tensioning arm 174.

The dispenser section DS is coordinated with the hoop wrapping system and principally with the carrier 16, mainly by the demand for strapping as it is wrapped around the package P, except for certain timing mechanism which has not been fully illustrated or described herein since such timing mechanism per se forms no part of the claimed invention. When there is no strap in the machine, both yokes 122 and 164 are drawn by their respective cables 130 and 182 downwardly so that they seat upon their respective limit abutments 131 and 184. However, when the strap S is initially applied to the machine for package wrapping purposes so that the free end of the strap is clamped between the anvil 20 and the gripper 24 as shown in FIG. 1, the yoke 122 rests upon its limit abutment 131 while yoke 164 is raised an appreciable distance above the abutment 184.

During the time that the carrier 16 moves from its initial starting position as shown in FIG. 1, to approximately its eleven o'clock position and thus approaches the centering rollers 74, a certain amount of strap is fed back into the primary storage system 108 of the dispenser system DS but then, as the carrier advances to its twelve o'clock position immediately below the centering rollers 74 as shown in FIG. 4, a small amount of this returned strap is again withdrawn. The net result of this strap storing and withdrawal operation causes the yoke 164 to become slightly lowered while the yoke 122 continues to seat upon the abutment 131.

Movement of the carrier to its approximate four o'clock position as illustrated in FIG. 5, pulls additional strap from the dispenser section as the carrier 16 recedes from the centering rollers 74 with the result that the yoke 164 moves to its uppermost position wherein the rollers 162 and 168 thereof are in horizontal alignment with the fixed rollers 160, 166 and 170, thus substantially exhausting the stored strap in the primary storage system 108 but not yet withdrawing any strap from the secondary storage system 106 so that the yoke 122 remains seated on the abutment 131. The aforementioned pinch or drag roller 128 insures exhaustion of the strap from the primary storage system 108 before any strap may be withdrawn from the secondary system 106.

At such time as the carrier 16, during its clockwise motion, leaves the position in which it is shown in FIG. 4, the solenoid 138 becomes energized, thus withdrawing the spring-biased locking lever 136 from the fixed bar 137 as shown in FIG. 6, thereby releasing the strapping so that further demands for strapping by the carrier 16 will withdraw such strapping from the secondary storage system 106, pull it through the primary storage system 108 and to the centering rollers 74. Continued clockwise motion of the carrier will pull the necessary amount of strapping from the secondary storage system 106 with the yoke 164 remaining fully elevated and with the yoke 122 being raised as shown in FIG. 6 against the action of the torsion spring 180. At some point in the machine cycle of clockwise carrier rotation, a condition of equilibrium, which depends upon the strength of the torsion spring 180, will obtain and the yoke will remain substantially at the same elevation since very little strap storing or strap feed-out operations take place during the strap sealing or joint forming operations which are shown in FIGS. 7, 8 and 9. However, it is important to note that in FIG. 8 where a final tension is applied to the strap hoop which completely encircles the package P at this time, and which was discussed in connection with the description of the final clockwise carrier movement that ends in FIG. 8, the solenoid 138 becomes de-energized, thus restoring the strap locking lever 136 to its binding relationship with respect to the fixed bar 137 and clamping the strap so that the previously described final pull exerted by the carrier 16 as it moves to its approximate terminal eight-thirty o'clock position will prevent any further withdrawal of strapping from the storage system 106 and insure that such strapping will be withdrawn from the storing and tensioning section 108. This application of final tension is a result of the motion of the carrier 16 from the position shown in FIG. 7 to the position shown in FIG. 8 where it will be observed that in the former view the carrier commences to pull the tensioning arm 174 upwardly against the action of the relatively heavy compression spring 190 (FIG. 3) as previously described, and that in the latter view the tensioning arm 174 is in its fully raised position. Immediately thereafter, and as set forth during the description of operation of the package wrapping system embodying the hoop 18 and its carrier 16, the counterclockwise motion of the hoop commences so that the hoop and its carrier restores strapping to the dispenser system DS. This initially restored strapping is immediately taken up by a lowering of the final tensioning arm as shown in FIG. 9 and a subsequent lowering of the yoke 168. Yoke 122 will create a certain amount of tension in the strap portions which are affected by the torsion spring 180 (FIG. 2) and, since the locking lever 136 has been restored to its strap locking position by de-energization of the solenoid 138, lowering of the yoke 122 will pull sufficient strapping from the strap reel 14 into the secondary storage region of the dispenser system DS without affecting the strapping in the primary storage region 108 and store the same for the next succeeding cycle of machine operation.

During the sealing or joint forming operations which take place as illustrated in FIGS. 11, 12, and 13, very little shifting of the carrier 16 takes place and therefore the various dispenser system instrumentalities including the yokes 122 and 164 remain substantially stationary and assume the positions in which they are illustrated in FIGS. 10 to 13 inclusive. During the counterclockwise cycle of package strapping, substantially the same dispenser section operations which have been described in connection with clockwise wrapping of the package P obtain, minor variations, however, becoming effective which are commensurate with strap feed-in and strap pull-out amounts as the carrier 16 performs its orbiting motion.

Figure 14:
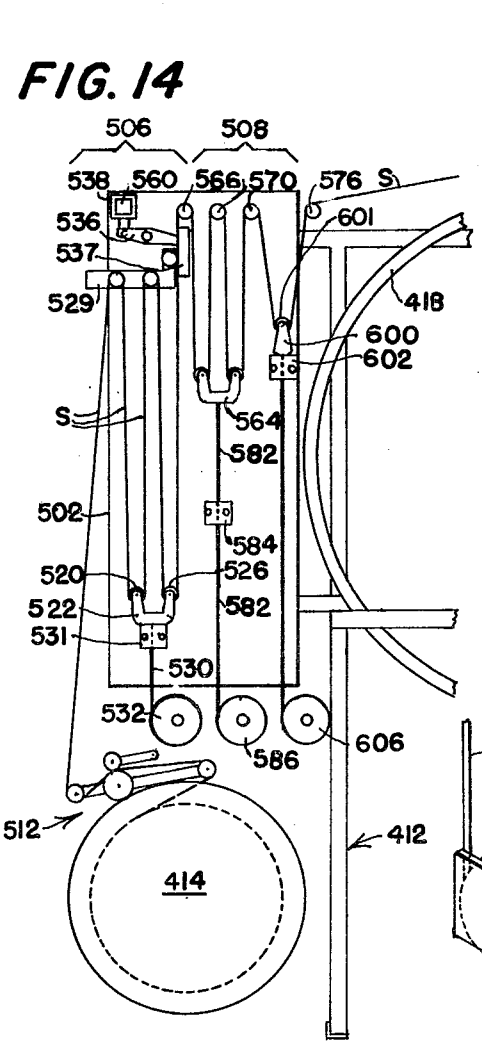
FIG. 14 is a fragmentary front elevational view of the dispenser section and showing a modified means for applying final tension to the banding strap after a complete strap loop has been drawn in either direction about the package.
Figure 15:
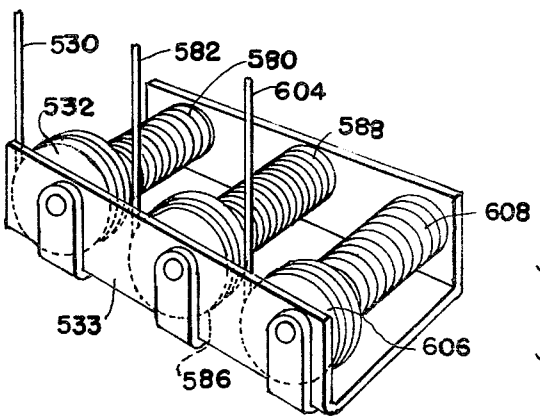
FIG. 15 is a fragmentary front perspective view, similar to FIG. 2, showing a spring and cable feed-out cluster which is employed in connection with the modified tensioning means of FIG. 14.

In FIGS. 14 and 15 a modified means for applying final tension to the loop to tighten it about the package immediately prior to effecting the sealing operation is shown. Such means contemplates the elimination of the final tensioning arm 174 and its associated roller 172 and the substitution therefor of a third yoke 600 (FIG. 14) which is similar to the yokes 122 and 164 except that it carries a single final tensioning roller 601, together with a yoke abutment 602 and cable 604 (see also FIG. 15) which is wrapped around and fixed to a third drum 606 which is biased in a counterclockwise direction by means of a third torsion spring 608, the various drums and torsion springs being suitably mounted within a cradle 533 (FIG. 15) similar to the cradle 133 of FIG. 2. In view of the similarity between the modified final tensioning structure of FIGS. 14 and 15 and the structures of FIGS. 1 and 2, and in order to avoid needless repetition of description, similar reference numerals but of a higher order have been applied to the corresponding parts as between these two pairs of views.

Whereas in the structure of FIGS. 7 and 8, the strong downward pull which is applied by the roller 172 to the strap bight which exists between the rollers 170 and 176 for final tensioning purposes as previously described by the spring 190 and arm 174 of FIG. 3, in the modified form of the invention shown in FIGS. 14 and 15 such final tension is effected by the downward pull of the single roller 601 carried by the yoke 600. Otherwise the strapping apparatus 210 including the hoop-initiated wrapping instrumentalities and the sealing instrumentalities remain unchanged.

(Strap Sealing Operations)

It has previously been briefly pointed out in connection with the description of the sequential package wrapping operations involving rotation of the hoop 18 that the vibrator 22 is shiftable vertically from a lowered inoperative position to a raised operative position where it cooperates with the functionally fixed anvil 20 for friction fusion operations on the overlapping portions of the completed strap loop that extends around the package P. It has also been briefly mentioned that the anvil 20 and its associated grippers 62 and 64 are horizontally slidable into and out of working position immediately beneath the plane of the lower face of the package P. These movements, of course, take place in the vicinity of the strapping station SS and the manner in which they are effected are shown in a more detailed manner in FIGS. 16 through 24 which will now be described in detail.

Referring now particularly to FIG. 16, the frame bars 38 carry a flat supporting plate 200 on which there is supported and anchored by means of screws 202 a fixed housing structure of irregular configuration and the various stationary portions of which have collectively been designated by the reference numeral 204 appropriately distributed throughout the disclosure of FIG. 16 and variously clamped together by clamping bolts 206.

Still considering FIG. 16 but in auxiliary association with FIG. 1, the frame bars 38 of the base structure 26, in addition to supporting the motor M1, also support a second motor M2 (FIG. 1) having a double ended drive shaft 210. The front end of the shaft 210 is connected by a belt and pulley arrangement 212 to a jack shaft 214 which, in turn, is connected by a belt and pulley arrangement 216 to an elongated camshaft 218 through the medium of a single revolution clutch assembly 217 (FIGS. 16 and 16*a*). The camshaft 218 is rotatably carried in bearings 219 on the framework 204. The rear end of the motor shaft 210 is connected by a belt and pulley arrangement 220 to the aforementioned eccentric shaft 90 by means of which the vibrator 22 is actuated.

It is to be noted at this point that the step-up ratio which is effected by the belt and pulley arrangement 220 between the motor shaft 210 of the motor M2 and the eccentric shaft 90 is relatively high so that a high rate of vibration is applied to the vibrator 22 at such time as it is in actual sealing cooperation with its associated anvil 20, as for example on the order of 6000 vibrations per minute. On the other hand, the step-down ratio which is effected by the two belt and pulley arrangements 212 and 216 between the motor shaft 210 and the camshaft 218 is relatively low and it is so designed that the camshaft makes one complete rotation during each complete rotation of the hoop 18 in either direction, all for a purpose that will become clear presently.

Whereas the belt and pulley arrangement 212 embodies pulleys which are fixedly secured on the motor shaft 210 and the jack shaft 214 so that the jack shaft rotates continuously with the motor shaft, the belt and pulley arrangement 220 embodies a loose pulley 222 (FIG. 16) which is freely rotatable on the eccentric shaft 90 so that this latter shaft does not necessarily rotate in unison with the motor shaft 210. An electrically operable clutch 224 on one side of the loose pulley 222 is effective when energized to engage the pulley 222 and eccentric shaft 90 for rotation in unison and an electric brake 226 on the other side of the pulley 222 is effective when energized to dampen the motion of the eccentric shaft 90. It will be understood therefore that when the clutch 224 is energized and the brake 226 is de-energized the vibrator 22 will be in operation. Conversely, when the clutch is deenergized and the brake is deenergized, the vibrator 22 will remain stationary. The clutch 224 and brake 226 are operable under the control of a switch 227 (FIG. 16).

It has previously been pointed out that the vibrator 22 is shiftable between the lowered position in which it is shown in FIG. 7 (full lines in FIG. 16) and the raised position in which it is shown in FIG. 9 (dotted lines in FIG. 16). It has also been pointed out that the anvil 20 is horizontally shiftable across the path of the strap loop, that the grippers 64 and 66 also are movable horizontally across the path of the strap loop, that the lift fingers 80 and 82 are movable horizontally across the path of the strap loop and that the cutter or knife 24 is horizontally shiftable through the path of the strap loop. As will be described in greater detail presently, the up and down motion of the vibrator 22, and also the in and out motion of the anvil are induced under the control of a disk cam 230 (FIGS. 16, 17 and 18) which is mounted on the camshaft 218, while motions of both the grippers 64 and 66 and of the knife or cutter 24 are induced under the control of the rear side of a double-faced barrel cam 232 which is likewise mounted on the camshaft 218. The front side of the barrel cam 232 serves to control the horizontal shifting motion of the two lift fingers 80 and 82.

Referring now to FIGS. 16 and 16*a*, the aforementioned single revolution spring clutch assembly 217 is mounted on the forward end of the camshaft 218 in the immediate vicinity of the belt and pulley arrangement 216 and is of a conventional spring wound type embodying the usual centripetal shaft-binding spring 236 and a stop lever 238 therefor. A solenoid 240 (FIG. 16*a*) which is responsive to both of the reversing switches RS1 and RS2 is effective upon energization thereof to momentarily release the lever 238 from the spring 236, thus allowing the cam shaft 218 and its associated cams to make one complete revolution in a clockwise direction as viewed in FIG. 1 and in a counterclockwise direction as seen in FIG. 18.

Referring now to FIG. 18 wherein the manner in which the vibrator 22 is raised and lowered under the influence of the cam 230 is best illustrated, such cam is shown in this view in its normal position of rest wherein a cam follower roller 242 rides upon a low area of the cam 230. The follower roller 242 is rotatably mounted on a pin 244 which extends across the bifurcated lower end 246 of a vertically shiftable inner slide member 248 which has a narrow stem 250 projecting upwardly therefrom. The inner slide member 248 is slidable in a bore 252 which is formed in an outer slide member 254, while the stem 250 is guided in a reduced counterbore 256 in the member 254. A pin 258 extends through the inner slide member 248 and has its opposite ends normally bearing against a circular pressure plate 260 which is suspended by screws 262 from the outer slide member 254. A relatively heavy compression spring 264 is disposed within the bore 252 and encompasses the stem 250 with its upper end bearing against the top wall of the counterbore 256 and its lower end bearing against the inner slide member 248, thus normally maintaining the pin 258 seated against the circular plate 260. Portions of the fixed framework 204 in the vicinity of the slide member 254 are provided with a pair of sockets 266 which serve to enclose a pair of hold-down springs 268 which yieldingly bias the circular plate 260, and consequently the outer slide member 254, with its enclosed compression spring 264 and inner slide member 248, downwardly and thus serve to maintain the follower roller 242 in engagement with the periphery of the cam 230.

Still referring to FIGS. 16 and 18, the vertically shiftable outer slide member 254 receives the aforementioned bearings 87 for the rock shaft 84 therein and thus the slide member and rock shaft are movable vertically in unison under the influence of the cam 230. An abutment or stop 270 is secured by means of a pair of screws 272 in a recess which is provided in the upper slide member by means of a series of shims 274. The function of the abutment 270 and its associated shims 274 will be set forth presently.

From the above description, it will be apparent that during each revolution of the disk cam 230, as the follower roller 242 rides outwardly and onto the raised portion of the cam, upward motion of the roller will exert an upward pressure upon the entire slide assembly including both the inner slide member 248 and the outer slide member 254, thereby raising the bearings 87 and their associated rock shaft 84. Upward movement of the rock shaft 84 also causes the slotted crank arm 85 (FIGS. 16, 18, and 21) to move upwardly from the lowered full line positions in which they are shown in FIG. 21 to the dotted line positions thereof. This collective movement of parts causes the vibrator 22 to move toward the anvil 20 which, at that time, has been projected into the path of the strap S. To prevent the vibrator 22 and anvil 20 from contacting each other if strap S has not been properly fed therebetween, the aforementioned abutment or stop 270 engages the underneath side of a thickened area 276 (FIG. 18) of the anvil 20, thus terminating the upward movement of the slide assembly including both the inner and the outer slide members 248 and 254. At this time the upper working end of the vibrator 22 has engaged the loop overlap immediately beneath the anvil as shown in dotted lines near the upper end of FIG. 21 and, since the power train leading to the vibrator 22, and which includes the belt and pulley arrangements 212 and 216 (FIG. 1), is effective due to engagement of the clutch 224 and release of the brake 226, the vibrator 22 becomes effective to perform its friction-fusion operation. It will be understood of course that the pressure which is maintained by the vibrator on the outer loop overlap so as to slide the same on the fixed inner loop overlap is attained by the relatively heavy spring 264 which, in addition to its pre-compressed force is given a further increment of force by a slight upward shifting of the inner slide member 248 as the follower roller 242 rides on the high area of the cam 230. The function of the aforementioned shims 274 is to allow for greater machining tolerances of stop 270 in order that it may protect the serrated surfaces of the anvil 20 and vibrator as described above in the event that no strap loop is present between the anvil and vibrator.

Considering now the manner in which the horizontal in and out shifting movement of the anvil 20 to bring the same into and out of the path of the strap loop as previously described is attained, such movement of the anvil is an indirect function of the disk cam 230 by reason of a lever and pawl arrangement which is designated in its entirety by the reference numeral 280 in FIG. 16 and which is illustrated in detail in FIGS. 22 and 23. Such arrangement involves in its general organization a lever 282, the distal end of which is forced so as to engage a pin 284 carried by the anvil 20 and which has its proximate end mounted on a fixed pin 285 mounted on a portion of the framework 204. Swinging movement of the lever 282 in a clockwise direction as viewed in FIGS. 22 and 23 will serve to slide the anvil 20 to the right so as to withdraw it from the path of the strap loop as shown in FIG. 24. A compression spring 286 which is nested in a recess 288 in the frame 204 yieldingly biases the lever 282 toward its anvil-projecting position. Pivoted to a medial region on the lever 282 is a thrust pawl 290 which is spring biased in a counterclockwise direction by means of a torsion spring 292 carried on a pin 293 so that when the inner slide member 248 is in its down position as shown in FIGS. 22 and 18, the pawl 290 slightly overhangs the adjacent edge of the slide member. As the slide member 248 moves to its up position as shown in FIG. 23, the pawl 290 becomes pushed out of the way and as the slide member attains its uppermost position, the pawl 290 falls into a notch 294 which is formed in the adjacent side of the slide member 248 and remains in such notch during the sealing operation which was described in connection with FIGS. 9 and 21. After the sealing operation has been completed and the loop overlap has been fused a short interval of time prevails to allow the fused overlap to harden, the inner slide commences its downward motion and, in so moving, the upper side of the notch 294 brings the pawl 290 against a shoulder 296 and exerts a compressional thrust upon the pawl 290, thus momentarily swinging the lever 282 in its clockwise direction just long enough to withdraw the anvil 20 from the path of the strap loop as shown in FIG. 12. Immediately thereafter, the torsion spring 292 restores the pawl to its normal position as shown in FIGS. 1 and 23 preparatory to performance of a succeeding strapping cycle.

Considering now the mode of operation of the two grippers 64 and 66, and referring particularly to FIGS. 16, 17, 20, 24 and 25, it has previously been pointed out that the rear side of the dualfaced barrel cam 232 (FIG. 16) is effective to control the motion of both grippers 64 and 66. Accordingly, a lever 300 is pivoted medially of its ends on a shaft 302 supported at its ends by the framework 204 and carries a follower roller 304 on its lower end which rides on a raised cam surface 306 on the rear side of the cam 232. The upper end of the lever projects into the confines of a cage-like gripper-actuating slide member 308 (FIGS. 20, 24 and 25) which establishes a pair of forwardly opening relatively large sockets 310 and a pair of rearwardly opening relatively small sockets 312. A pair of compression springs 314 disposed in the sockets 310 yieldingly bias the cage-like slide 308 rearwardly, thus urging the lever 300 in a clockwise direction as viewed in FIG. 16 and maintaining the follower roller 304 against the cam surface 306. A pair of springs 316 are disposed in the sockets 312 and bear at their rear ends against a pair of gripper-actuating links 318, the nature of which will be set forth presently.

The individual grippers 64 and 66 are in the form of jaw members which are pivoted together for swinging movement toward and away from each other about the axis of a fixed pin 320 (FIG. 20) which has a drive fit with a socket provided in the framework 204 in the vicinity of the sealing station SS. Each jaw member (gripper) is connected to a respective link 318 by pin and slot connections 322. Forward extensions 324 on the slide member 308 carry upstanding pins 326 which project through slots 328 in the links 318.

From the above description, it will be apparent that when the follower roller 304 (FIGS. 16 and 20) rides on a high spot on the rear side of the cam 232, the upper end of the lever 300 will restrain the cage-like slide member 308, thus compressing the springs 314 and maintaining the slide member in the left hand position in which it is shown in FIGS. 20 and 25 so that the pins 326 will draw the links 318 to the left and thus swing the jaw members (grippers) 64 and 66 to the open positions and away from the anvil 20 for strap-releasing purposes. Conversely, when the follower roller 304 rides on a low spot on the rear side of the cam 232, the lever will swing in a clockwise direction and the upper end thereof will release the slide member 308 so that the springs 314 will urge such member to the right as viewed in FIG. 24, thus shifting the pins 326 to positions wherein the links 318 will force the gripper members 64 and 66 to their closed strap gripping position as shown in this view.

As shown in FIGS. 20, 24 and 25, a stop flange or abutment 330 is disposed immediately forwardly of the pivoted grippers 64 and 66, such flange being formed on a base structure 332 which is secured to the appropriate part of the framework 204 by means of a pair of hold-down clamping screws 334. The function of the flange 330 is to act as a limit stop for the anvil 20 when the latter is projected to its advanced position across the strap path, and also to act as a limit stop for the forward bodily sliding motion of the gripper assembly 64, 66 so that in the event that the anvil 20 is removed from the machine for any reason, as for example inspection of parts, replacement or repair, the entire cage-like slide member and all of the parts associated therewith will not be ejected from their positions of placement in the machine.

It has previously been pointed out that the sliding motion of the strap-severing cutter or knife 24 is effected under the control of the rear side of the double-faced barrel cam 232 (FIG. 16) and consequently under the control of the swinging movements of the follower lever 300. The details of the cutter or knife 24 are best shown in FIGS. 26 and 27, these two views being somewhat similar to FIGS. 24 and 25 respectively inasmuch as the section line 24—24 which forms the basis for both FIGS. 24 and 25 is taken immediately below the knife 24 so that such knife does not appear in these two latter views, whereas in FIGS. 26 and 27, the knife 24 is shown in position directly above the slide member 308.

Considering the knife 24 per se, this element is in the form of a flat elongated plate-like case hardened steel member of generally rectangular design and having identical strap severing ends in order that the knife may be reversed after one end thereof has become dull. The medial region of the knife 24 is secured by a pair of screws 340 to the forward end region of the cage-like slide member 308 so that the knife moves bodily with such slide member.

Each strap-severing end of the knife 24 is formed with a medial strap-displacing ramp-like cam surface 342 which is flanked by a pair of sharpened cutting edges 344. The function of the cam surface 342 is to enter between the strap loop overlap and the adjacent face of the package P so as to move the fused overlap portion of the strap loop slightly away from the anvil to facilitate passage of the cutting edges 344 edgewise through the strap S. The leading edge of the ramp-like cam surface 342 precedes the cutting edge by a slight dimension on the order of one-eighth of an inch, thus progressively twisting the strap as the cutting action takes place to maintain the portion of the strap undergoing severing at a right angle to the cutting edges.

Considering now the manner in which the lift fingers 80 and 82 are retracted as previously outlined in connection with the description of FIG. 13, and referring particularly to FIGS. 16, 19 and 20, such retraction of the fingers takes place under the control of the rear side of the double-faced barrel cam 232 and also of the swinging movements of a lever arm 350 which is pivoted medially of its ends on a fixed shaft 352 supported at its ends by the framework. The lower end of the lever arm 350 carries a follower roller 354 designed for engagement with a raised cam surface 355 on the rear side of the cam 232. The upper end of the lever 350 receives therethrough a bar 356 (FIGS. 16 and 19), the outer ends of which have pin and slot connections 358 with a pair of spaced apart slidable thrust rods 360 supported in bearings 362. The front end of the two thrust rods 360 serve to support the lower ends of the lift arms 80 and 82 respectively so that such lift arms perform their swinging movements about the horizontal axes of the thrust rods 360. The two lift arms 80 and 82 are collectively biased to the retracted rear positions in which they are shown in FIGS. 16 and 20 by means of compression springs 364 which are effective between the framework 204 and the outer end portions of a crossbar 366 which extends through the lever arm 350 above the level of the pivot shaft 352. Such lift arms are individually biased to their lower positions as shown in full lines in FIGS. 17 and 19, as well as in FIGS. 4 through 8 and 13, by means of respective torsion springs 368 carried on the thrust rods 360 which appear only in FIG. 17.

The manner in which the lift fingers 80 and 82 are caused to perform swinging movements about their pivotal axes under the influence of the package-wrapping operation as the hoop-mounted carrier 16 orbits the strapping area SA has previously been set forth in connection with the sequential package wrapping operations illustrated in FIGS. 1 and 2 through 13. Particularly in FIG. 6 it will be noted that shortly after the strap S has been wrapped around three sides of the package P and has engaged the lower right hand corner of the package, it is pulled by the carrier slip rollers 70 as indicated by the dotted line axis x—x in this view so that it rides edgewise upwardly alongside the rear surface of the vibrator 22. At this time the edge of the strap S remote from the vibrator is confined by the existence of a generally upright U-shaped plate 370 which constitutes a portion of the fixed framework 104 (FIGS. 17 and 19) so that the strap progressively becomes "twisted" so to speak as indicated in FIG. 16 and when it approaches the extreme upper end region of the anvil 20 the plane of the strap is at a right angle to the normal plane of the strap. Immediately after the strap rises above the level of the anvil, it is released from its confinement, and it twists to its horizontal plane directly above the vibrator 22 where it is effectively positioned between the anvil 20 and upper end of the vibrator 22 for subsequent friction fusion purposes as previously outlined.

As shown fragmentarily in FIGS. 16, 17, 18 and 20, the fixed framework 104 includes an upper cover plate 372 which is secured in position by screws 206 above the cutter knife 24 and the various gripper actuating mechanism immediately beneath the knife.

In view of the fact that operation of the package wrapping facilities involving gripping of the free end of the strapping and orbiting of the hoop-mounted carrier 16 about the strapping area SA in opposite directions to establish closed strapping loops has been described in considerable detail in connection with the sequential views involving FIGS. 1 and 4 through 13; that a detailed description of the feed out and feed back of the strapping material from and to the storage system 106 (FIG. 1) for hoop requirements and consequent package wrapping purposes has also been treated in connection with these sequential views involving FIGS. 1 and 4 through 13; that strap feed from the strap reel 14 of the secondary storage system 108 to the primary storage system 106 have been adequately discussed; that a detailed description of the sealing operation as it is conducted by relative effective cooperating movements of the anvil 20 and the vibrator 22, and by projection of these sealing instrumentalities into and out of the strap path at appropriate times; and that the function and mode of operation of lift fingers 80 and 82 have been fully described, it is deemed unnecessary to conclude this specification by rendering a comprehensive description of the step-by-step operation of the machine. It is believed that the above description will suffice to afford a full understanding of the machine and its operation, as well as to indicate the many advantageous features thereof.

The invention is not to be limited to the exact arrangement of parts shown in the accompanying drawings or described in this specification as various changes in the details of construction may be resorted to without departing from the spirit of the invention. Therefore, only insofar as the invention has particularly been pointed out in the accompanying claims is the same to be limited.

What is claimed is:

1. In a machine operative upon successive lengths of flexible strapping issuing from a strap reel for forming successive strap loops about an object disposed at a strapping area, in combination, releasable means for clamping and holding the free end of each successive strapping length in close proximity to the object, a rotatable hoop encircling said strapping area, a carrier mounted on the hoop in slip-feed engagement with the strapping between its free end and the reel, means for successively rotating the hoop in opposite directions to perform successive machine cycles and thus orbit the carrier about the strapping area in either direction to thereby transport the carrier alternately in clockwise and counterclockwise directions to form strap loops having overlapping end portions about the object, a centering device interposed between the carrier and the reel and disposed exteriorly of the hoop, a storage mechanism effectively interposed between the centering device and the reel for assimilating slack in the strapping as the carrier approaches the centering device in either direction and for payng out such slack as the carrier recedes from the centering device, means disposed substantially diametrically opposite to the centering device for sealing said overlapping end portions of the successively formed strap loops, a pair of strap-reversing rollers shiftable in unison in the axial direction of the hoop from a retracted position remote from the plane of the hoop to an advanced position wherein they lie substantially in such plane and in the general vicinity of said clamping and holding means and around which the strapping makes a reverse bend alternately shortly after the hoop changes its direction of rotation, means individually biasing said rollers to positions which, when the rollers are in their advanced positions, are slightly removed from said clamping and holding means, said rollers being forcibly pulled alternately by successive reverse bends against the action of said biasing means into close proximity to said clamping and holding means for cooperation of the latter with the free ends of successive strapping loops, and mean for shifting said strap-reversing rollers.

2. In a machine operative upon a length of flexible strapping issuing from a strap reel for forming a closed loop about an object disposed at a strapping area, in combination, means for clamping and holding the free end of the strapping in close proximity to the object, rotatable means constructed and arranged to encircle said strapping area including a carrier in slip-feed engagement with the strapping between its free end and the reel, means for rotating said rotatable means to thus orbit the carrier about the strapping area and transport the strapping about the object to form a strap loop having overlapping end portions, a centering device interposed between the carrier and reel, a strap dispensing and storing mechanism effectively interposed between the centering device and reel for assimilating slack in the strapping as the carrier approaches the centering device and for paying out such slack as the carrier recedes from the centering device, said mechanism embodying a secondary storage region for receiving strapping from the reel and a primary storage region for receiving strapping from the secondary region, a releasable strap clamping device normally effective upon the strapping between the primary and secondary regions for preventing strapping from entering the primary region from the secondary region, means for releasing said strap clamping device at such time as slack in the primary region has been fully payed out to permit strapping to be drawn from the secondary region to the primary region, means disposed substantially diametrically opposite to the centering device for sealing said overlapping end portions, and means for severing the loop from the strap issuing from said reel.

3. The combination set forth in claim 2, wherein said strap clamping device is in the form of a reaction bar and a cooperating self-energizing lever.

4. The combination set forth in claim 2, wherein a strap snubbing mechanism is interposed between the strap reel and said secondary storage region for preventing overrunning of the reel when strapping enters the latter region from the reel.

5. The combination set forth in claim 4, wherein the strap reel embodies a drum on which the strapping is involutely wound, and a pair of circular side flanges, and said strap snubbing mechanism includes a lever-like arm pivoted medially of its ends for limited rocking movement of the arm, a pair of strap-guiding rollers on the opposite ends of said arm, said strapping passing over one of said rollers and beneath the other roller, a compound roller mounted on said arm between its pivot point and one of said rollers, said compound roller including a relatively small diameter friction roller which rides on a rim of one of said side flanges, and a relatively large diameter roller which cooperates with a pinch roller to engage the strapping therebetween, and spring means for biasing the lever in a direction to cause the small diameter roller to frictionally engage said side flange of the drum.

6. The combination set forth in claim 5, wherein said compound roller embodies a pair of small diameter outside rollers which ride on the rims of respective side flanges of the drum, and said large diameter roller projects between said side flanges.

7. The combination set forth in claim 1, wherein each storage region embodies a series of staggered rollers around which the strapping passes in serpentine fashion, and spring means is provided for yieldingly biasing one set of alternate rollers of the series away from the other set of alternate rollers in the series.

8. The combination set forth in claim 7, wherein one set of alternate rollers are fixed, while the other set of alternate rollers are movable toward and away from said one set of rollers.

9. The combination set forth in claim 8, wherein the fixed rollers of said one set are two in number, the set of movable rollers of the other set also are two in number and are carried on a shiftable yoke, a cable has one end thereof secured to said yoke and has its other end wound upon and secured to a rotatable drum, and a torsion spring is effective to bias the drum in a cable winding direction.

10. The combination set forth in claim 2, wherein said rotatable means is in the form of a generally circular hoop encircling the strapping area, said primary storage region serving to draw and store slack from said centering device during a predetermined initial degree of rotation of the hoop and thereafter to return such stored slack to the centering device during continued rotation of the hoop, said secondary storage region serving to draw and store strap from said reel during such continued rotation of the hoop to provide a reserve supply of strapping for subsequent transfer to the primary storage region during such continued rotation and after the strapping in the primary storage region has been exhausted, said releasable strap clamping device being effective during said initial degree of rotation of the hoop becoming released during said continued rotation of the hoop.

11. The combination set forth in claim 10, wherein a table-like support is disposed in said strapping area for loosely receiving the object thereon, said primary storage region initially serves to return a major portion of the stored slack therein to the centering device under relatively light tension insufficient to effect dislodgment of the loosely supported object in the strapping area during said continued rotation of the hoop, and subsequently serves to return the remainder of such stored strapping to the centering device under relatively high tension during terminal rotation of the hoop immediately prior to severing of the loop.

12. A slip-feed strapping machine as set forth in claim 10, wherein said hoop is rotatably supported by a series of at least three centering rollers in tangential rolling contact therewith at circumferentially spaced regions therearound, at least two of said centering rollers being opposed by backing rollers likewise in tangential rolling contact with the hoop, one of said rollers constituting a friction driving roller for the hoop, and the means for rotating the hoop embodies an electric motor operatively connected in driving relationship to said friction driving roller.

13. The combination set forth in claim 10, wherein said primary storage region embodies first spring biasing means effective at all times against the strapping issuing from the centering device to tension such strapping and thus yieldingly urge the same toward a stored position within such primary region, and the secondary storage region further embodies a second spring biasing means effective against the strapping issuing from said reel when said strap clamping device is released.

14. The combination set forth in claim 13, wherein the spring biasing means associated with each storage region includes a series of staggered rollers around which the strapping passes in serpentine fashion, and spring means is provided for yieldingly biasing one set of alternate rollers of the series away from the other set of alternate rollers in the series.

15. The combination set forth in claim 13, wherein said first spring biasing means exerts a relatively light tension in the strapping leading from said primary storage region to the centering device, and additional and normally ineffective third spring biasing means are engageable with the strapping between said primary storage region and the centering device, said additional spring means becoming effective to exert a relatively heavy tension in the strapping at such time as the strapping in said primary storage region approaches its condition of terminal exhaustion.

16. A slip-feed strapping machine as set forth in claim 15, wherein said additional spring means embodies a normally fixed final tensioning roller around which the strapping passes and which is dislodged from its normally fixed position so as to exert a relatively high degree of final tension on the strapping shortly before the strap in the primary storage system of the dispenser has been exhausted and immmediately prior to the sealing operation.

17. A slip-feed strapping machine as set forth in claim 16, wherein said final tensioning roller is mounted on the distal end of a spring-biased swinging arm which yieldingly urges such roller to its normally fixed position.

18. The combination set forth in claim 16, wherein the final tensioning roller is mounted on a shiftable yoke, a cable has one end thereof secured to said yoke and its other end secured to and wound upon a drum, and a torsion spring is provided for applying winding tension to said drum.

19. A slip-feed strapping machine for wrapping a length of flexible strapping about an object to provide a tensioned loop having overlapping end portions which are sealed together to provide a vertically disposed loop overlap, said machine comprising in combination means establishing a strapping area, a strap dispensing and storing section alongside the strapping area, and a sealing station beneath the strapping area, a support for the object within the strapping area, a circular rotatable hoop encompassing the strapping area, means for rotating said hoop, a package draping carrier mounted on the hoop in slip-feed engagement with the strapping and effective upon rotation of the hoop to orbit the strapping area and thus withdraw strapping from the dispensing section and progressively apply the same to the object to produce the loop and its overlap, a horizontally slidable anvil at said sealing station and normally projecting into the vertical plane of the loop whereby, upon orbiting of the carrier, the loop is caused to encompass the anvil along with the object, a gripper movable into and out of clamping engagement with the anvil for releasably holding the free end of the strapping during orbital movement of the carrier, said anvil having a downwardly facing strap-engaging surface, a vibrator having an upwardly facing strap-engaging surface designed for cooperation with said downwardly facing anvil surface to compress the loop overlap, said vibrator being vertically shiftable between a lowered inoperative position and a raised strap-engaging position, first cam means for shifting the vibrator between its raised and lowered positions and also for retracting the anvil from the vertical plane of the loop, means effective upon movement of the vibrator to its raised operative position for oscillating the same relative to the anvil, and second cam means for moving said gripper into and out of clamping engagement with the anvil.

20. A slip-feed strapping machine as set forth in claim 19, wherein spring means are provided for normally urging said anvil into the plane of said loop, and downward movement of the vibrator under the influence of said first cam means is effective to shift the anvil out of said plane.

21. A slip-feed strapping machine as set forth in claim 19, wherein said first cam means embodies a vertically shiftable slide member upon which said vibrator is mounted for oscillation, a spring yieldingly urging said anvil to its projected position, and a thrust pawl effective between the anvil and a shoulder on said slide member to force the anvil to a retracted position out of the plane of said loop during downward motion of the slide member.

22. A slip-feed strapping machine as set forth in claim 19 including, additionally, a horizontally slidable cutter knife movable between a retracted position and an advanced position wherein it projects through the vertical plane of the strap loop in the vicinity of said loop overlap to sever the loop from the dispensing section, and said second cam means is effective to shift said knife between its retracted and its advanced position.

23. A slip-feed strapping machine as set forth in claim 22, wherein said gripper is in the form of a pivoted jaw member having a jaw surface movable toward and away from said anvil between strap clamping and strap releasing positions respectively, a horizontally shiftable slide member is provided with a pin and slot connection with the jaw member, said slide member is shiftable under the influence of said second cam means, and said cutter knife is secured to said slide member and moves bodily therewith.

24. A slip-feed strapping machine as set forth in claim 23 wherein said cutter knife is in the form of an elongated plate-like member having cutting edges at its opposite ends, and is releasably secured to said slide member whereby it may be reversed when the cutting edge at one end becomes dull due to prolonged use.

25. A slip-feed strapping machine as set forth in claim 24, wherein a ramp-like cam surface is formed on each end of the cutter knife and is designed for entry into the space between the loop overlap and the object undergoing strapping in advance of the adjacent cutting edge to facilitate passage of such cutting edge endwise through the strapping and at a right angle relative to the plane of such strapping at its point of severance.

26. A slip-feed strapping machine for wrapping successive lengths of flexible strapping alternately in opposite directions about an object to provide vertically disposed tensioned loops having overlapping end portions which are sealed together to provide loop overlaps, said machine comprising in combination means establishing a strapping area, a strap dispensing and storing section alongside the strapping area, and a sealing station beneath the strapping area, a support for the object within the strapping area, a circular rotatable hoop encompassing the strapping area, means for successively rotating the hoop in opposite directions, a package draping carrier mounted on the hoop in slip-feed engagement with the strapping and effective upon rotation of the hoop in either direction to orbit the strapping area and thus withdraw strapping from the dispensing section and progressively apply the same to the object to produce a loop and its associated overlap, a horizontally slidable anvil at said sealing station and normally projecting into the vertical plane of the successive loops whereby, upon orbiting of the carrier in either direction, a loop is caused to encompass the anvil along with the object, a pair of grippers, one on each side of the anvil, movable in unison toward and away from the anvil to releasably clamp the free ends of successive strapping lengths against the anvil during orbital movement of the carrier, said anvil having a downwardly facing strap-engaging surface, a vibrator having an upwardly facing strap-engaging surface designed for cooperation with said downwardly facing anvil surface to compress the loop overlaps, said vibrator being vertically shiftable between a lowered inoperative position and a raised strap-engaging position, a pair of strap-reversing rollers shiftable bodily in unison into and out of the plane of successive strap loops in the vicinity of said sealing means and around which the strapping makes a reverse bend alternately shortly after the hoop changes its direction of rotation, first cam means for shifting the vibrator between its raised and lowered positions and also for retracting the anvil from the vertical plane of successively formed loops, means effective upon movement of the vibrator to its raised operative position for oscillating the same relative to the anvil, second cam means for moving said grippers toward and away from the anvil, and third cam means for shifting said strap-reversing rollers.

27. A slip-feed strapping machine as set forth in claim 26, wherein spring means are provided for normally urging said anvil into the plane of successive loops, annd downward movement of the vibrator under the influence of said first cam means is effective to shift the anvil out of said plane.

28. A slip-feed strapping machine as set forth in claim 26, wherein said first, second and third cams are mounted for rotation in unison on a common crankshaft.

29. A slip-feed strapping machine as set forth in claim 26, wherein said strap-reversing rollers are individually biased to positions slightly removed from said sealing means and are forcibly pulled by the alternate reverse bends into close proximity to said sealing means.

30. A slip-feed strapping machine as set forth in claim 26, wherein said first cam means embodies a vertically shiftable slide member upon which said vibrator is mounted for oscillation, a spring yieldingly urging said anvil to its projected position, and a thrust pawl effective between the anvil and a shoulder on said slide member to force the anvil to a retracted position out of the plane of said loop during downward motion of the slide member.

31. A slip-feed strapping machine as set forth in claim 26, including, additionally, a horizontally slidable cutter knife movable between a retracted position and an advanced position wherein it projects through the vertical plane of the strap loop in the vicinity of said loop overlap to sever the loop from the dispensing and storing section, and said second cam means is effective to shift said knife between its retracted and its advanced position.

32. A slip-feed strapping machine as set forth in claim 31, wherein said grippers are in the form of pivoted jaw members having jaw surfaces which straddle the anvil when the latter is in its projected position and which are movable toward and away from the sides of the anvil between strap clamping and strap releasing positions respectively, a horizontally shiftable slide member is provided with pin and slot connections with the jaw members, said slide member is shiftable in unison under the influence of said second cam means, and said cutter knife is secured to said slide member.

* * * * *